US006064280A

United States Patent [19]

Onzuka

[11] Patent Number: 6,064,280

[45] Date of Patent: May 16, 2000

[54] DELAY LINE WITH SHAPED CONDUCTORS MINIMIZING SIGNAL REFLECTIONS

[75] Inventor: Tatsunori Onzuka, Tokyo, Japan

[73] Assignee: NEC Corporation, Tokyo, Japan

[21] Appl. No.: 09/086,537

[22] Filed: May 29, 1998

[30] Foreign Application Priority Data

Mar. 24, 1998 [JP] Japan ..... 10-076027

[51] Int. Cl.[7] ..... H01P 1/18

[52] U.S. Cl. ..... 333/156; 333/160

[58] Field of Search ..... 333/156, 160

[56] References Cited

U.S. PATENT DOCUMENTS 4,614,922 9/1986 Bauman et al. ..... 333/160 X 4,788,515 11/1988 Wong et al. ..... 333/160

*Primary Examiner*—Justin P. Bettendorf

*Attorney, Agent, or Firm*—Sughrue, Mion, Zinn Macpeak & Seas, PLLC

[57] ABSTRACT

In a delay line, an inside conductor has straight inside conductors and curved inside conductors each of which is positioned between adjacent two ones of the straight inside conductors, each of the curved inside conductors is connected to the adjacent two ones of the straight inside conductors. A first outside conductor has an inside surface which defines a receiving ditch which receives the inside conductor. A second outside conductor covers an aperture of the receiving ditch.

25 Claims, 24 Drawing Sheets

DELAY LINE WITH SHAPED CONDUCTORS MINIMIZING SIGNAL REFLECTIONS

BACKGROUND OF THE INVENTION

This invention relates to a delay line which delays a phase of a high frequency wave.

DESCRIPTION OF THE RELATED ART

In the manner which will later be described in detail, the first convention delay line is a delay line of a coaxial type. The first delay line comprises an inside conductor, an outside conductor, a dielectric member, and an outside covering member.

In the manner which will later be described in detail, the second conventional delay line is a delay line of a microstrip line type. The second conventional delay line comprises a ceramic substrate, a winding microstrip line, a ground conductor, and connector terminals. The second delay line 11 comprises the necessary long winding microstrip line.

However, the first and second conventional delay lines have following disadvantages. In case that the outside covering member of the first conventional delay line has a diameter of about 10 mm, the first conventional delay line has a diameter of several tens cm. As a result, the first conventional delay line has a small electric delay amount and a great size.

The winding microstrip line of the second conventional delay line has a remarkably thin. Also, the ceramic substrate of the second conventional delay line has a high dielectric constant. As a result, the second conventional delay line has a high frequency loss and a small withstand power.

SUMMARY OF THE INVENTION

It is therefore an object of this invention to provide a delay line which has a great electric delay amount, a small high frequency loss, a small size, and a great withstand power.

Other objects of this invention will become clear as the description proceeds.

According to a first aspect of this invention, there is provided a delay line comprising:

an inside conductor having a plurality of straight inside conductors and a plurality of curved inside conductors each of which is positioned between adjacent two ones of the straight inside conductors, each of the curved inside conductors is connected to the adjacent two ones of the straight inside conductors; and an outside conductor having an inside surface which defines a receiving ditch which receives the inside conductor.

According to a second aspect of this invention, there is provided a delay line comprising:

an inside conductor having a plurality of straight inside conductors and a plurality of curved inside conductors each of which is positioned between adjacent two ones of the straight inside conductors, each of the curved inside conductors is connected to the adjacent two ones of the straight inside conductors;

a first outside conductor having an inside surface which defines a receiving ditch which receives the inside conductor; and a second outside conductor which covers an aperture of the receiving ditch.

According to a third aspect of this invention, there is provided a delay line comprising:

an inside conductor having a plurality of straight inside conductors and a plurality of curved inside conductors each of which is positioned between adjacent two ones of the straight inside conductors, each of the curved inside conductors is connected to the adjacent two ones of the straight inside conductors;

a first outside conductor having a first inside surface which defines a first receiving ditch which receives the inside conductor; and a second outside conductor having a second inside surface which defines a second receiving ditch which is associated with the first receiving ditch and receives the inside conductor.

According to a fourth aspect of this invention, there is provided a delay line comprising:

a first inside conductor having a plurality of first straight inside conductors and a plurality of first curved inside conductors each of which is positioned between adjacent two ones of the first straight inside conductors, each of the first curved inside conductors is connected to the adjacent two ones of the first straight inside conductors;

an outside conductor having an inside surface which defines a receiving ditch which receives the first inside conductor; and a second inside conductor positioned in parallel to a part of the first inside conductor.

According to a fifth aspect of this invention, there is provided a delay line comprising:

a first inside conductor having a plurality of first straight inside conductors and a plurality of first curved inside conductors each of which is positioned between adjacent two ones of the first straight inside conductors, each of the first curved inside conductors is connected to the adjacent two ones of the first straight inside conductors;

a first outside conductor having an inside surface which defines a receiving ditch which receives the first inside conductor;

a second outside conductor which covers an aperture of the receiving ditch; and a second inside conductor positioned in parallel to a part of the first inside conductor.

According to a sixth aspect of this invention, there is provided a delay line comprising:

a first inside conductor having a plurality of first straight inside conductors and a plurality of first curved inside conductors each of which is positioned between adjacent two ones of the first straight inside conductors, each of the first curved inside conductors is connected to the adjacent two ones of the first straight inside conductors;

a first outside conductor having a first inside surface which defines a first receiving ditch which receives the first inside conductor;

a second outside conductor having a second inside surface which defines a second receiving ditch which is associated with the first receiving ditch and receives the first inside conductor; and a second inside conductor positioned in parallel to a part of the first inside conductor.

According to a seventh aspect of this invention, there is provided a delay line comprising:

an inside conductor having a whirl shape; and an outside conductor having an inside surface which defines a receiving ditch which receives the inside conductor.

According to an eight aspect of this invention, there is provided a delay line comprising:

an inside conductor having a whirl shape;

a first outside conductor having an inside surface which defines a receiving ditch which receives the inside conductor; and a second outside conductor which covers an aperture of the receiving ditch.

According to an ninth aspect of this invention, there is provided a delay line comprising:

an inside conductor having a whirl shape;

a first outside conductor having a first inside surface which defines a first receiving ditch which receives the inside conductor; and a second outside conductor having a second inside surface which defines a second receiving ditch which is associated with the first receiving ditch and receives the inside conductor.

According to a tenth aspect of this invention, there is provided a delay line manufacturing method comprising:

a step of preparing a first metal plane;

a step of punching the first metal plane to form an inside conductor having a plurality of straight inside conductors and a plurality of curved inside conductors each of which is positioned between adjacent two ones of the straight inside conductors, each of the curved inside conductors is connected to the adjacent two ones of the straight inside conductors;

a step of preparing a second metal plane;

a step of cutting the second metal plane to form an outside conductor having an inside surface which defines a receiving ditch which receives the inside conductor; and a step of positioning the inside conductor in the receiving ditch of the outside conductor.

According to an eleventh aspect of this invention, there is provided a delay line manufacturing method comprising:

a step of preparing a first metal plane;

a step of punching the first metal plane to form an inside conductor having a plurality of straight inside conductors and a plurality of curved inside conductors each of which is positioned between adjacent two ones of the straight inside conductors, each of the curved inside conductors is connected to the adjacent two ones of the straight inside conductors;

a step of preparing a second metal plane;

a step of cutting the second metal plane to form a first outside conductor having an inside surface which defines a receiving ditch which receives the inside conductor;

a step of preparing a third metal plane;

a step of cutting the third metal plane to form a second outside conductor which covers an aperture of the receiving ditch;

a step of positioning the inside conductor in the receiving ditch of the first outside conductor;

a step of positioning the second outside conductor so that the second outside conductor covers said aperture of the receiving ditch of the first outside conductor; and a step of fixing the second outside conductor to the first outside conductor.

According to a twelfth aspect of this invention, there is provided a delay line manufacturing method comprising:

a step of preparing a first metal plane;

a step of punching the first metal plane to form an inside conductor having a plurality of straight inside conductors and a plurality of curved inside conductors each of which is positioned between adjacent two ones of the straight inside conductors, each of the curved inside conductors is connected to the adjacent two ones of the straight inside conductors;

a step of preparing a second metal plane;

a step of cutting the second metal plane to form a first outside conductor having a first inside surface which defines a first receiving ditch which receives the inside conductor;

a step of preparing a third metal plane;

a step of cutting the third metal plane to form a second outside conductor having a second inside surface which defines a second receiving ditch which is associated with the first receiving ditch and receives the inside conductor;

a step of positioning the inside conductor in the receiving ditch of the first outside conductor;

a step of positioning the second outside conductor so that the second outside conductor covers the aperture of the first receiving ditch of the first outside conductor and so that the second receiving ditch is associated with the first receiving ditch and receives the inside conductor; and a step of fixing the second outside conductor to the first outside conductor.

According to a thirteenth aspect of this invention, there is provided a delay line manufacturing method comprising:

a step of preparing a first metal plane;

a step of punching the first metal plane to form a first inside conductor having a plurality of first straight inside conductors and a plurality of first curved inside conductors each of which is positioned between adjacent two ones of the first straight inside conductors, each of the first curved inside conductors is connected to the adjacent two ones of the first straight inside conductors;

a step of preparing a second metal plane;

a step of cutting the second metal plane to form an outside conductor having an inside surface which defines a receiving ditch which receives the first inside conductor;

a step of preparing a third metal plane;

a step of punching the third metal plane to form a second inside conductor positioned in parallel to a part of the first inside conductor; and a step of positioning the first inside conductor and the second inside conductor in the receiving ditch of the outside conductor.

According to a fourteenth aspect of this invention, there is provided a delay line comprising:

a step of preparing a first metal plane;

a step of punching the first metal plane to form a first inside conductor having a plurality of first straight inside conductors and a plurality of first curved inside conductors each of which is positioned between adjacent two ones of the first straight inside conductors, each of the first curved inside conductors is connected to the adjacent two ones of the first straight inside conductors;

a step of preparing a second metal plane;

a step of cutting the second metal plane to form a first outside conductor having an inside surface which defines a receiving ditch which receives the first inside conductor;

a step of preparing a third metal plane;

a step of cutting the third metal plane to form a second outside conductor which covers an aperture of the receiving ditch;

a step of preparing a fourth metal plane;

a step of cutting the fourth metal plane to form a second inside conductor positioned in parallel to a part of the first inside conductor;

a step of positioning the first inside conductor and the second inside conductor in the receiving ditch of the first outside conductor so that the second inside conductor is positioned in parallel to the part of the first inside conductor;

a step of positioning the second outside conductor so that the second outside conductor covers the aperture of the first receiving ditch of the first outside conductor; and a step of fixing the second outside conductor to the first outside conductor.

According to a fifteenth aspect of this invention, there is provided a delay line comprising:

a step of preparing a first metal plane;

a step of punching the first metal plane to form a first inside conductor having a plurality of first straight inside conductors and a plurality of first curved inside conductors each of which is positioned between adjacent two ones of the first straight inside conductors, each of the first curved inside conductors is connected to the adjacent two ones of the first straight inside conductors;

a step of preparing a second metal plane;

a step of cutting the second metal plane to form a first outside conductor having a first inside surface which defines a first receiving ditch which receives the first inside conductor;

a step of preparing a third metal plane;

a step of cutting the third metal plane to form a second outside conductor having a second inside surface which defines a second receiving ditch which is associated with the first receiving ditch and receives the first inside conductor;

a step of preparing a fourth metal plane;

a step of cutting the fourth metal plane to form a second inside conductor positioned in parallel to a part of the first inside conductor;

a step of positioning the first inside conductor and the second inside conductor in the first receiving ditch of the first outside conductor so that the second inside conductor is positioned in parallel to the part of the first inside conductor;

a step of positioning the second outside conductor so that the second outside conductor covers the aperture of the first receiving ditch of the first outside conductor and so that the second receiving ditch is associated with the first receiving ditch and receives the first inside conductor and the second inside conductor; and a step of fixing the second outside conductor to the first outside conductor.

According to a sixteenth aspect of this invention, there is provided a delay line comprising:

a step of preparing a first metal plane;

a step of punching the first metal plane to form an inside conductor having a whirl shape;

a step of preparing a second metal plane;

a step of cutting the second metal plane to form an outside conductor having an inside surface which defines a receiving ditch which receives the inside conductor; and a step of positioning the inside conductor in the receiving ditch of the outside conductor.

According to a seventeenth aspect of this invention, there is provided a delay line comprising:

a step of preparing a first metal plane;

a step of punching the first metal plane to form an inside conductor having a whirl shape;

a step of preparing a second metal plane;

a step of cutting the second metal plane to form a first outside conductor having an inside surface which defines a receiving ditch which receives the inside conductor;

a step of preparing a third metal plane;

a step of cutting the third metal plane to form a second outside conductor which covers an aperture of the receiving ditch;

a step of positioning the second outside conductor so that the second outside conductor covers the aperture of the first receiving ditch of the first outside conductor; and a step of fixing the second outside conductor to the first outside conductor.

According to an eighteenth aspect of this invention, there is provided a delay line comprising:

a step of preparing a first metal plane;

a step of punching the first metal plane to form an inside conductor having a whirl shape;

a step of preparing a second metal plane;

a step of cutting the second metal plane to form a first outside conductor having a first inside surface which defines a first receiving ditch which receives the inside conductor;

a step of preparing a third metal plane;

a step of cutting the third metal plane to form a second outside conductor having a second inside surface which defines a second receiving ditch which is associated with the first receiving ditch and receives the inside conductor;

a step of positioning the first inside conductor and the second inside conductor in the first receiving ditch of the first outside conductor so that the second inside conductor is positioned in parallel to the part of the first inside conductor;

a step of positioning the second outside conductor so that the second outside conductor covers the aperture of the first receiving ditch of the first outside conductor and so that the second receiving ditch is associated with the first receiving ditch and receives the first inside conductor and the second inside conductor; and a step of fixing the second outside conductor to the first outside conductor.

DESCRIPTION OF THE PREFERRED EMBODIMENTS

Figure 1:
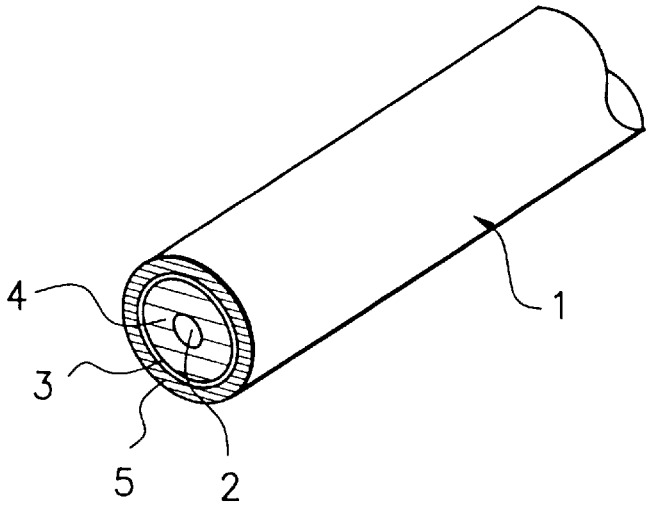
FIG. 1 PRIOR ART
FIG. 1 is an enlarged perspective view of a part of a first conventional delay line.
Figure 2:
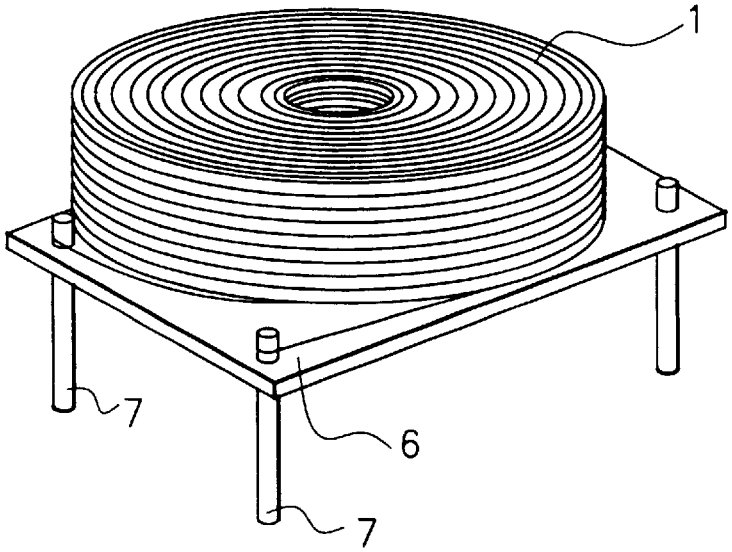
FIG. 2 PRIOR ART
FIG. 2 is a perspective view of the first conventional delay line illustrated in FIG. 1.

Referring to FIGS. 1, 2, 3, and 4, first and second a conventional delay lines will be described for a better understanding of this invention. In FIGS. 1 and 2, the first conventional delay line 1 is a delay line of a coaxial type. The first conventional delay line 1 comprises an inside conductor 2, an outside conductor 3, a dielectric member 4, and an outside covering member 5. As the first conventional delay line 1, a semi-rigid cable is used in case that the outside covering member 5 of the first conventional delay line 1 has a diameter of less than 10 mm. As the first conventional delay line 1, a high frequency coaxial cable is used in case that the outside covering member 5 of the first conventional delay line 1 has a diameter of not less than 10 mm. The first conventional delay line 1 comprises a necessary long coaxial. The first conventional delay line 1 is mounted on a base table 6. The first conventional delay line 1 is electrically connected to an outside device (not shown) through connectors 7.

Figure 3:
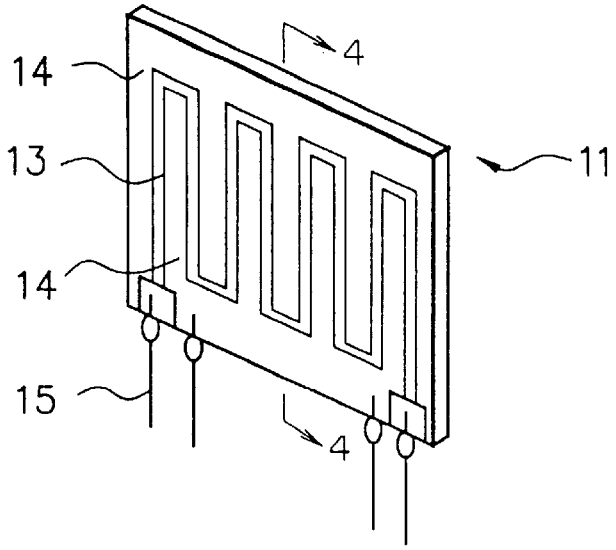
FIG. 3 PRIOR ART
FIG. 3 is a perspective view of a second conventional delay line.
Figure 4:
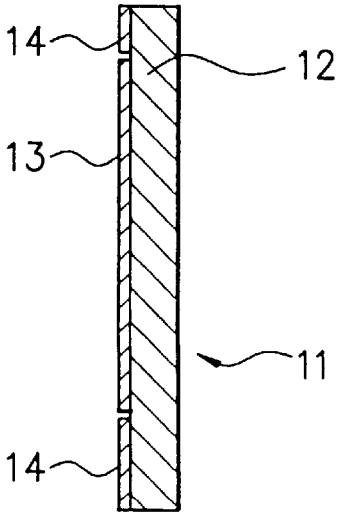
FIG. 4 PRIOR ART
FIG. 4 is a sectional view taken along a line 4—4 in FIG. 3.

In FIGS. 3 and 4, the second conventional delay line 11 is a delay line of a microstrip line type. The second conventional delay line 11 comprises a ceramic substrate 12, a winding microstrip line 13, a ground conductor 14, and connector terminals 15. The second conventional delay line 11 comprises the necessary long winding microstrip line 13.

However, the first and second conventional delay lines 1 and 11 have following disadvantages. In case that the outside covering member 5 of the first conventional delay line 1 has a diameter of about 10 mm, the first conventional delay line 1 has a diameter of several tens cm. As a result, the first conventional delay line 1 has a small electric delay amount and a great size.

The winding microstrip line 13 of the second conventional delay line 11 has a remarkably thin. Also, the ceramic substrate 12 of the second conventional delay line 11 has a high dielectric constant. As a result, the second conventional delay line 11 has a high frequency loss and a small withstand power.

Figure 5:
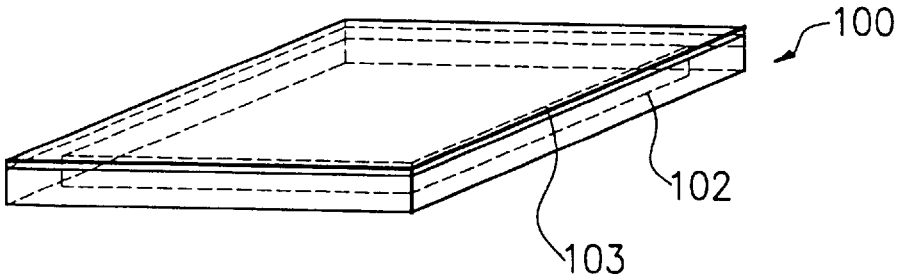
FIG. 5 is a schematic perspective view of a delay line according to a first embodiment of this invention.
Figure 6:
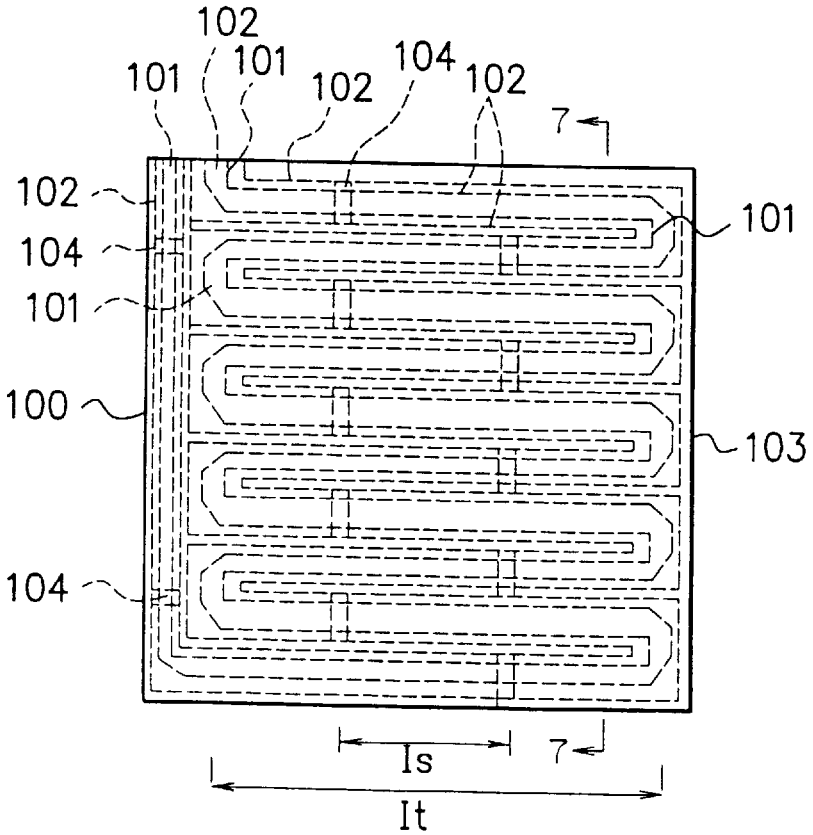
FIG. 6 is a schematic plane view of the delay line illustrated in FIG. 5.
Figure 7:
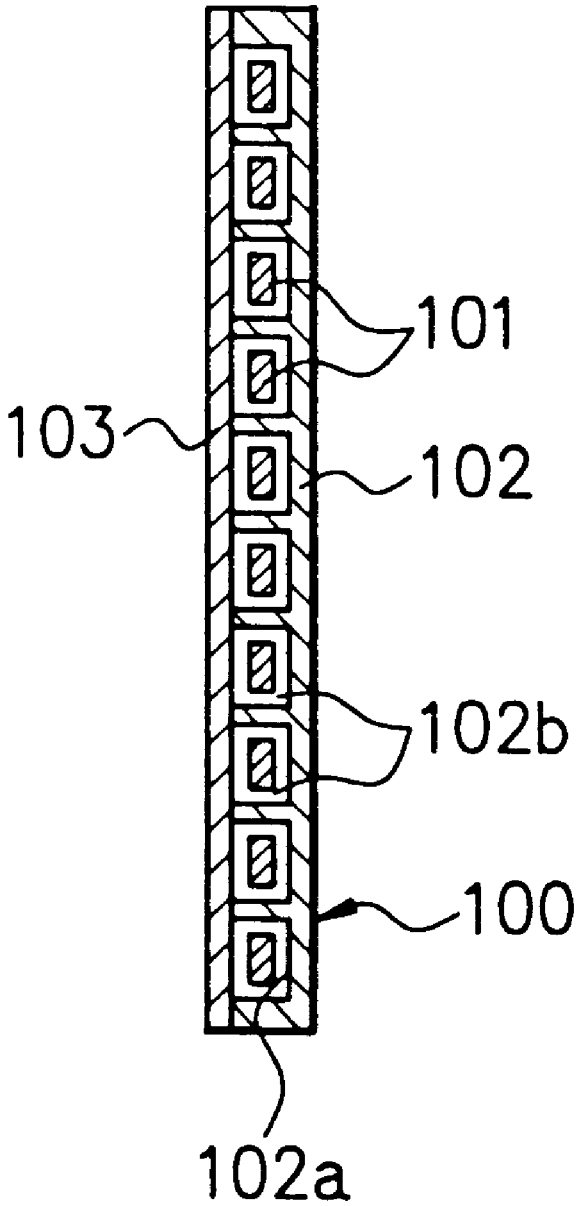
FIG. 7 is a schematic sectional view taken along a line 7—7 in FIG. 6.

Referring to FIGS. 5, 6, 7, 8, 9, 10, 11, 12, 13, 14, 15, 16, 17, 18, 19, 20, 21, 22, and 23, the description will proceed to a delay line according to a first embodiment of this invention. In FIGS. 5, 6, and 7, the delay line 100 comprises an first inside conductor 101, a first outside conductor 102, a second outside conductor 103, and a plurality of dielectric supporting members 104.

Figure 8:
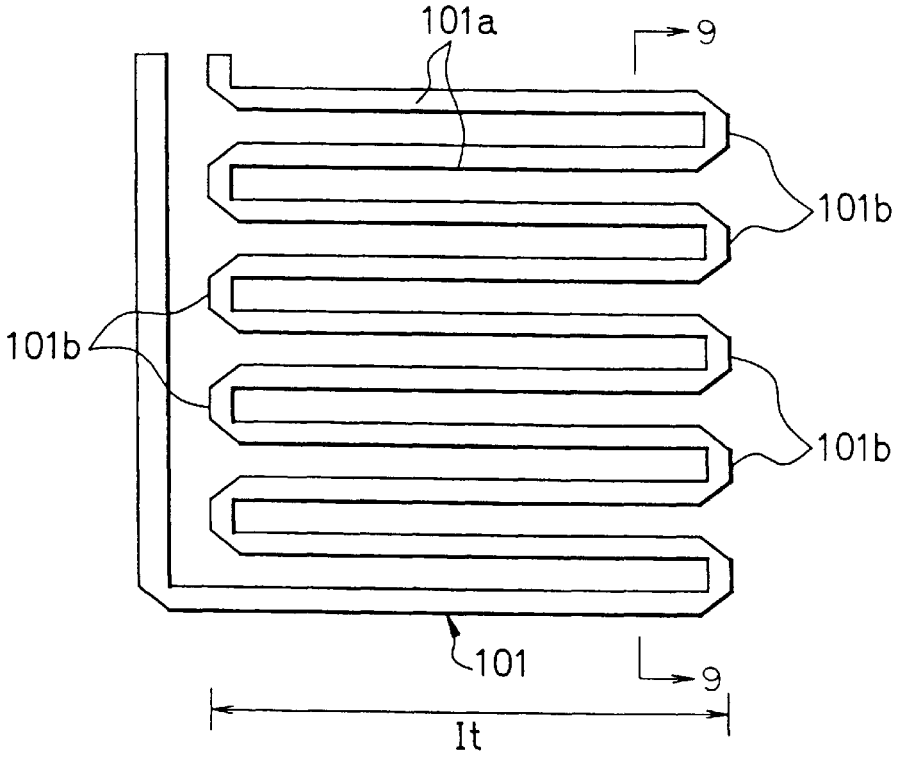
FIG. 8 is a plane view of an inside conductor of the delay line illustrated in FIG. 5.
Figure 9:
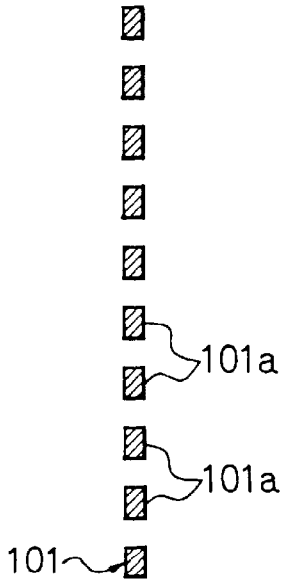
FIG. 9 is a sectional view taken along a line 9—9 in FIG. 8.

In FIGS. 8 and 9, the first inside conductor 101 has a plurality of straight inside conductors 101*a* and a plurality of curved inside conductors 101*b*. Each of the curved inside conductors 101*b* is positioned between adjacent two ones of the straight inside conductors 101*a*. Each of the curved inside conductors 101*b* is connected to ends of the adjacent two ones of the straight inside conductors 101*a*. The straight inside conductors 101*a* has a length It.

Figure 10:
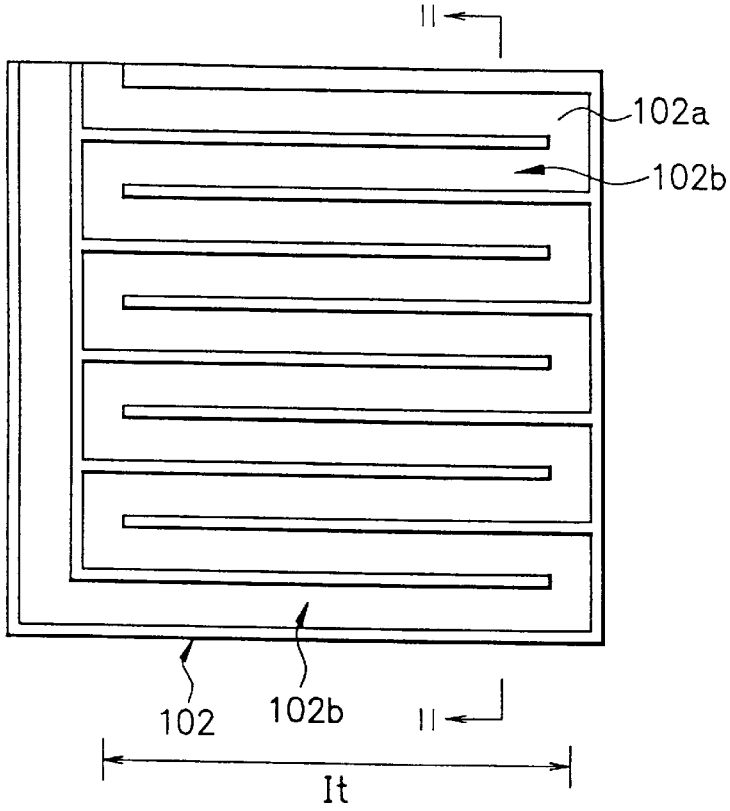
FIG. 10 is a plane view of a first outside conductor of the delay line illustrated in FIG. 5.
Figure 11:
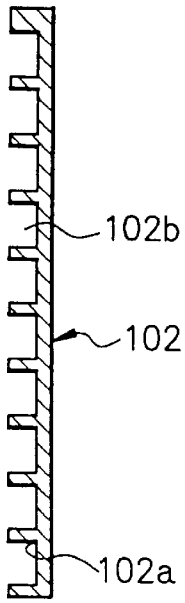
FIG. 11 is a sectional view taken along a line 11—11 in FIG. 10.
Figure 12:
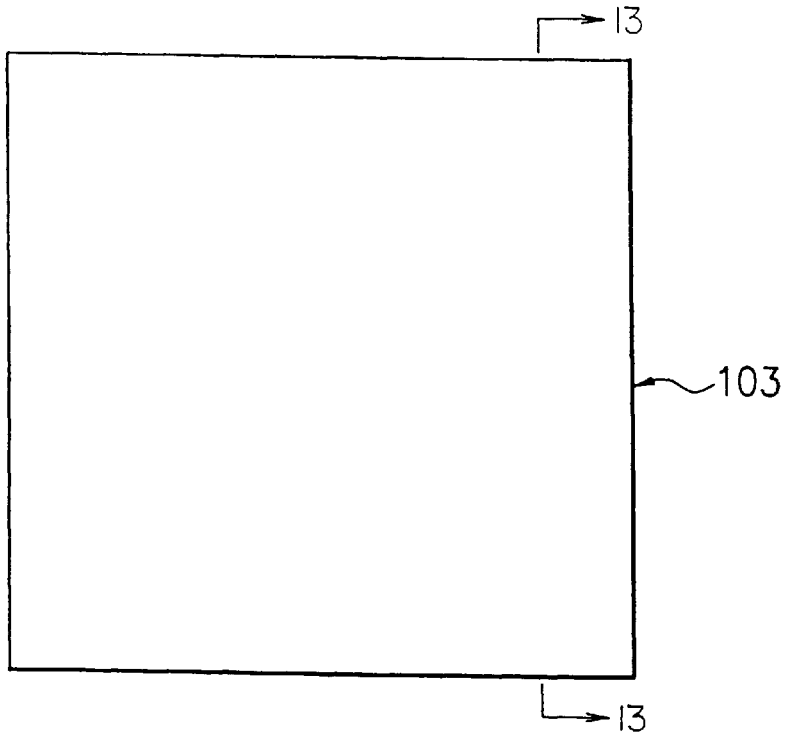
FIG. 12 is a plane view of a second outside conductor of the delay line illustrated in FIG. 5.
Figure 13:
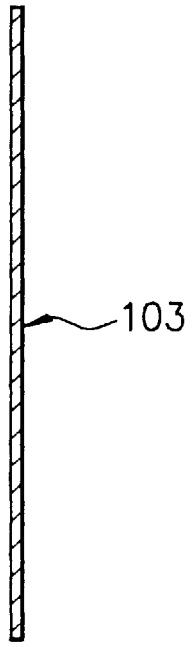
FIG. 13 is a sectional view taken along a line 13—13 in FIG. 12.

In FIGS. 10 and 11, the first outside conductor 102 has an first inside surface 102*a* which defines a first receiving ditch 102*b* which receives the first inside conductor 101. The first inside conductor 101 and the first inside surface 102*a* are spaced constant distance apart. In FIGS. 12 and 13, the second outside conductor 103 has a plane shape. The second outside conductor 103 is positioned so that the second outside conductor 103 covers an aperture of the first receiving ditch 102*b* which is defined by the first inside surface 102*a*.

The inside conductor 101, the first outside conductor 102, and the second outside conductor 103 are formed of conductive body. Preferably, the first inside conductor 101, the first outside conductor 102, and the second outside conductor 103 are formed of copper which has superior high frequency characteristic. The first inside conductor 101, the first outside conductor 102, and the second outside conductor 103 are formed by galvanizing conductive material to the conductive body. As the conductive material, conductive material, such as gold, which has superior high frequency characteristic is used. Also, the first inside conductor 101, the first outside conductor 102, and the second outside conductor 103 are formed by galvanizing conductive material to a surface of dielectric body.

Turning back to FIGS. 5, 6, and 7, the dielectric supporting members 104 are positioned in the first receiving ditch 102*b* so that the dielectric supporting members 104 are in contact with the first inside surface 102*a*. The dielectric supporting members 104 has superior high frequency characteristic. The dielectric supporting members 104 hold and support the first inside conductor 101.

Figure 14:
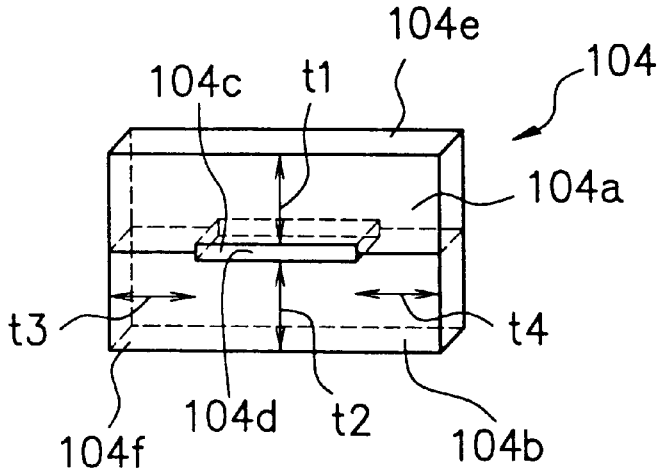
FIG. 14 is a perspective view of a supporting member of the delay line illustrated in FIG. 5.
Figure 15:
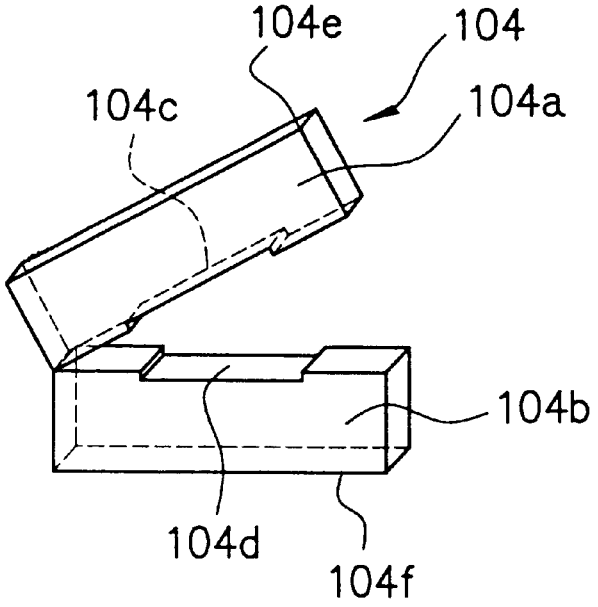
FIG. 15 is an exploded perspective view of the supporting member illustrated in FIG. 14.

In FIGS. 14 and 15, the dielectric supporting member 104 comprises a first supporting piece 104*a* and a second supporting piece 104*b*.

Figure 16:
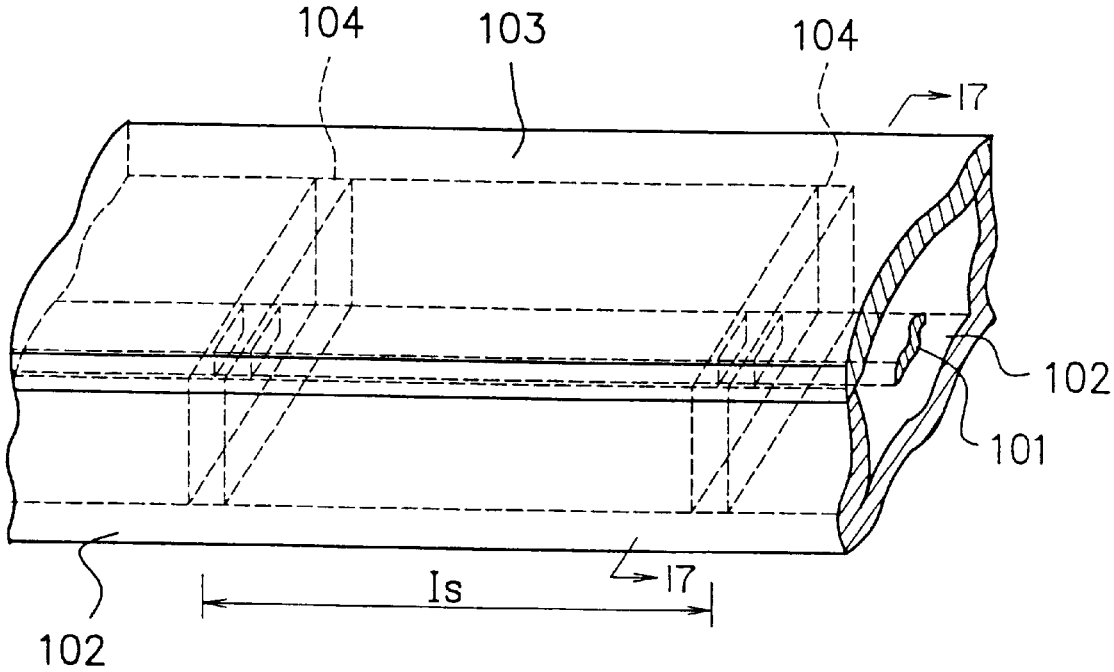
FIG. 16 is an enlarged schematic perspective view of a part of the delay line illustrated in FIG. 5.
Figure 17:
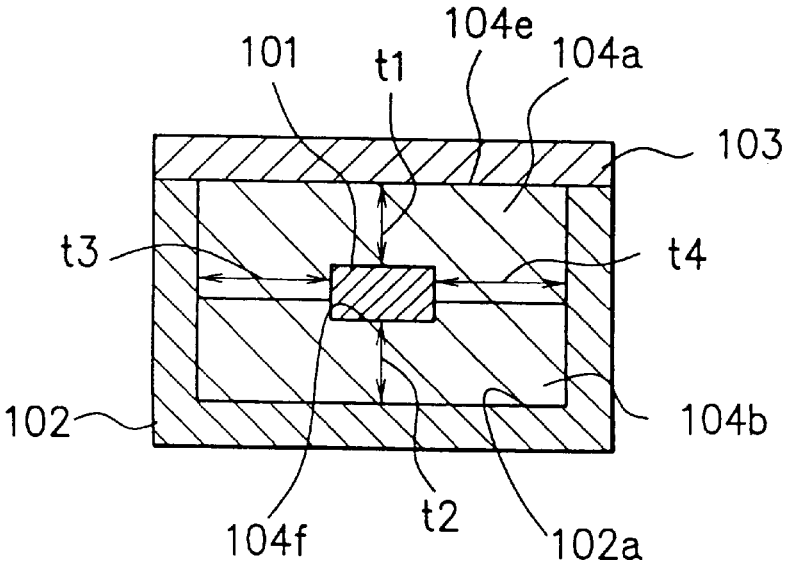
FIG. 17 is a sectional view taken along a line 17—17 in FIG. 16.

The first supporting piece 104*a* and the second supporting piece 104*b* have a first nipping surface 104*c* and a second nipping surface 104*d* which are opposed. The first nipping surface 104*c* and the second nipping surface 104*d* nip the first inside conductor 101. As shown in FIGS. 16 and 17, outside surfaces 104*e* and 104*f* of the first supporting piece 104*a* and the second supporting piece 104*b* are in contact with the first inside surface 102*a*. Thereby, the dielectric supporting members 104 holds and supports the first inside conductor 101.

The dielectric supporting members 104 is formed by means of a moulding method. The dielectric supporting members 104 is formed of dielectric material. Preferably, the dielectric supporting members 104 is formed of phytetrafluoroethylene which has high dielectric constant and a small dielectric dissipation factor.

It is assumed that a distance between a top surface of the outside surface 104*e* and the first nipping surface 104*c* is equal to t1, a distance between a bottom surface of the outside surface 104*f* and the second nipping surface 104*d* is equal to t2, a distance between a first side surface of the outside surface 104*e* and a first side surface of the first nipping surface 104*c* is equal to t3, and a distance between a second side surface of the outside surface 104*e* and a second side surface of the first nipping surface 104*c* is equal to t4. It is set that a distance between a first side surface of the outside surface 104*f* and a first side surface of the second nipping surface 104*d* is equal to t3, and a distance between a second side surface of the outside surface 104*f* and a second side surface of the second nipping surface 104*c* is equal to t4. In this event, it is set that t1 is equal to t2, t3, and t4 and t1 is constant.

In addition, it may be set that t1 is not equal to t2, t3, and t4 and t1 is not constant. In case of pertinently selecting sizes of the first inside conductor 101, the first outside conductor 102, the second outside conductor 103, and the dielectric supporting members 104, it is possible to obtain a pertinent line impedance.

Each of the dielectric supporting members 104 has a first dielectric constant. An air has a second dielectric constant which is different from the first dielectric constant. As a result, as line impedances of portions of the delay line 100 change, reflection of the high frequency is caused. In order to prevent occurrence of reflection of the high frequency, it is set that two adjacent ones of the dielectric supporting members 104 are spaced an integral number times of about ¼ of used wavelength apart. Namely, the dielectric supporting members 104 are positioned with a distance is left between two adjacent ones of the dielectric supporting members 104. Thereby, it is possible to decrease a reflecting power of the delay line 100.

Figure 18:
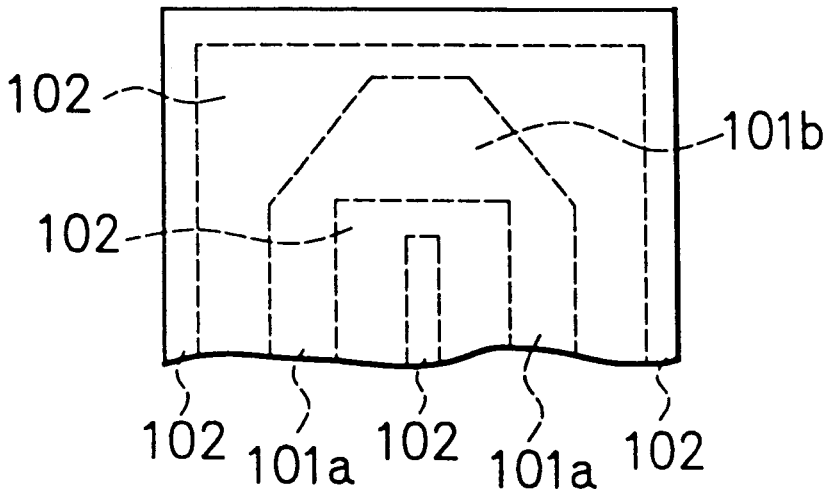
FIG. 18 is an enlarged plane view of another part of the delay line illustrated in FIG. 5.
Figure 19:
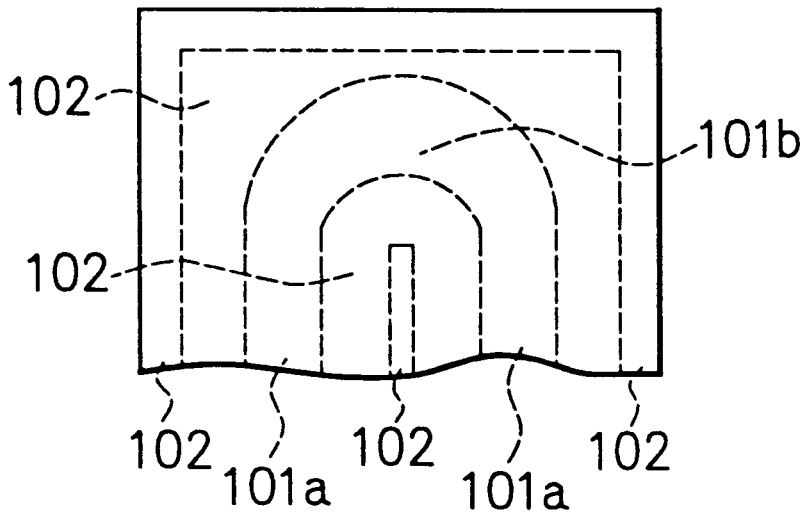
FIG. 19 is an enlarged plane view of another part of the delay line illustrated in FIG. 5.

As shown in FIGS. 18 and 19, a shape of the curved inside conductors 101*b* is selected so as to decrease a reflecting power of the delay line 100.

Also, it is set that each of the straight inside conductors has a length It which is equal to an odd number times of about ¼ of used wavelength so as to decrease a reflecting power of the delay line 100. This is because a phase of a wavelength of a reflecting wave of the high frequency is shifted by about ½ of the wavelength of the reflecting wave.

Referring to FIGS. 20, 21, 22, and 23 together with FIGS. 5 to 19, the description will proceed to a delay line manufacturing method for manufacturing the delay line 100. Similar parts are designated by like reference numerals.

Figure 20:
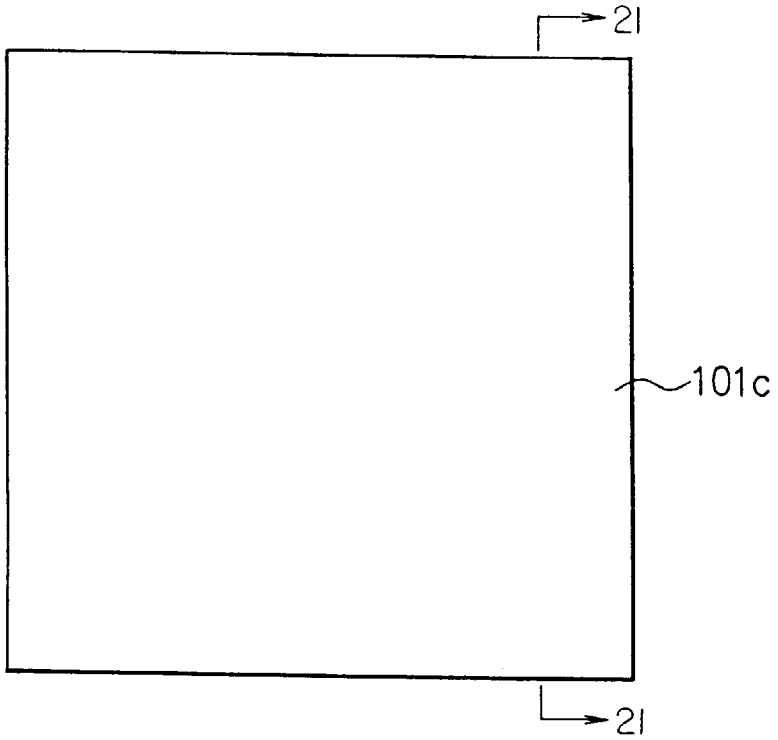
FIG. 20 is a plane view for describing a manufacturing method of the inside conductor of the delay line illustrated in FIG. 5.
Figure 21:
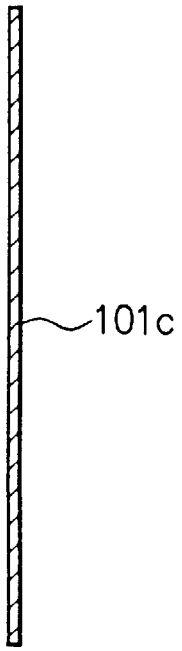
FIG. 21 is a sectional view taken along a line 21—21 in FIG. 20.

Firstly, as shown in FIGS. 20 and 21, a metal plane 101*c* was prepared. The metal plane 101*c* has a thickness of a few mm. As shown in FIGS. 8 and 9, the first inside conductor 101 was formed by punching, by a punching metal, the metal plane 101*c*. Also, a dielectric plane having a same shape of the metal plane 101*c* was prepared. Also, the first inside conductor 101 was formed by galvaning the dielectric plane to have a metal film after the dielectric plane were punched by the punching metal.

Figure 22:
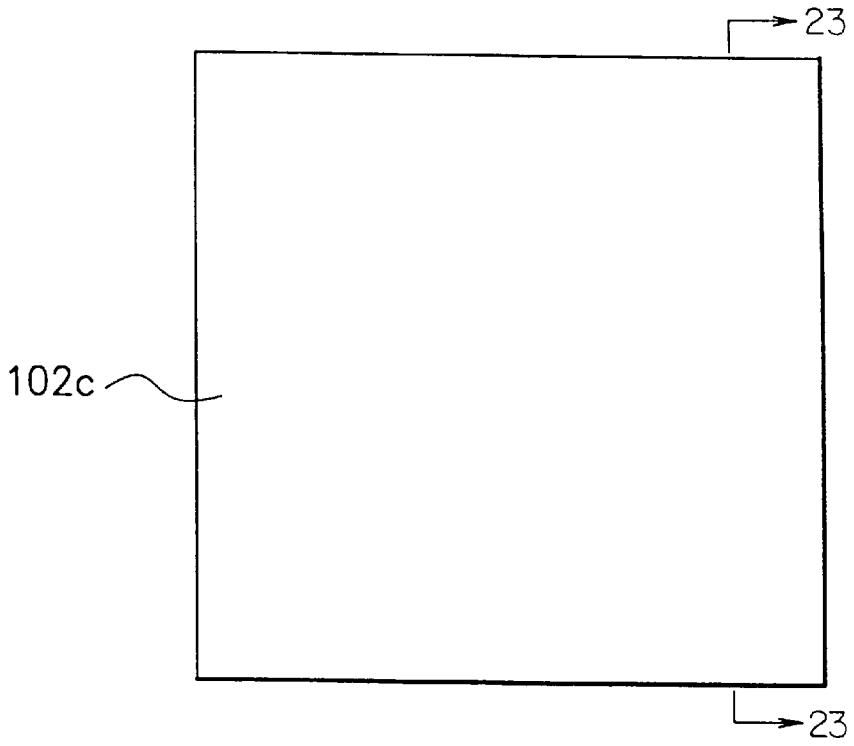
FIG. 22 is a plane view for describing a manufacturing method of the outside conductor of the delay line illustrated in FIG. 5.
Figure 23:
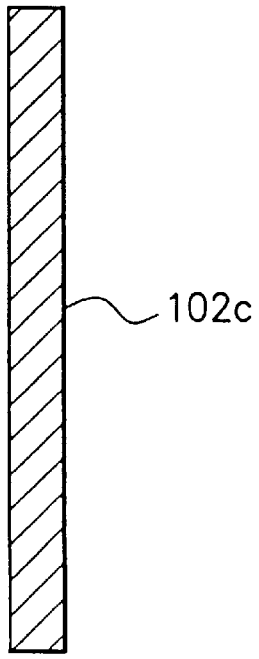
FIG. 23 is a sectional view taken along a line 23—23 in FIG. 22.

Next, as shown in FIGS. 22 and 23, a metal plane 102*c* was prepared. As shown in FIGS. 10 and 11; the first outside conductor 102 was formed by cutting the metal plane 102*c*. Next, as shown in FIGS. 14 and 15, the dielectric supporting members 104 were formed by means of the moulding method.

Next, the first inside conductor 101 was nipped by the dielectric supporting members 104. Next, as shown in FIG. 16, the first inside conductor 101 and the dielectric supporting members 104 were inserted in the first receiving ditch 102*b* of the first outside conductor 102.

Next, another metal plane (not shown) was prepared. As shown in FIGS. 12 and 13, the second outside conductor 103 was formed by cutting the other metal plane. Next, as shown in FIG. 7, the second outside conductor 103 was positioned to cover an aperture of the first receiving ditch 102*b* of the first outside conductor 102. Finally, in this sate, the second outside conductor 103 was fixed, by using screws, to the first outside conductor 102.

Referring to FIGS. 24, 25, 26, 27, 28, the description will proceed to a delay line according to a second embodiment of this invention. Similar parts are designated by like reference numerals. The delay line 100*v* comprises the first inside conductor 101, the first outside conductor 102, a second outside conductor 103*v*, and the dielectric supporting members 104 (FIG. 14).

Figure 24:
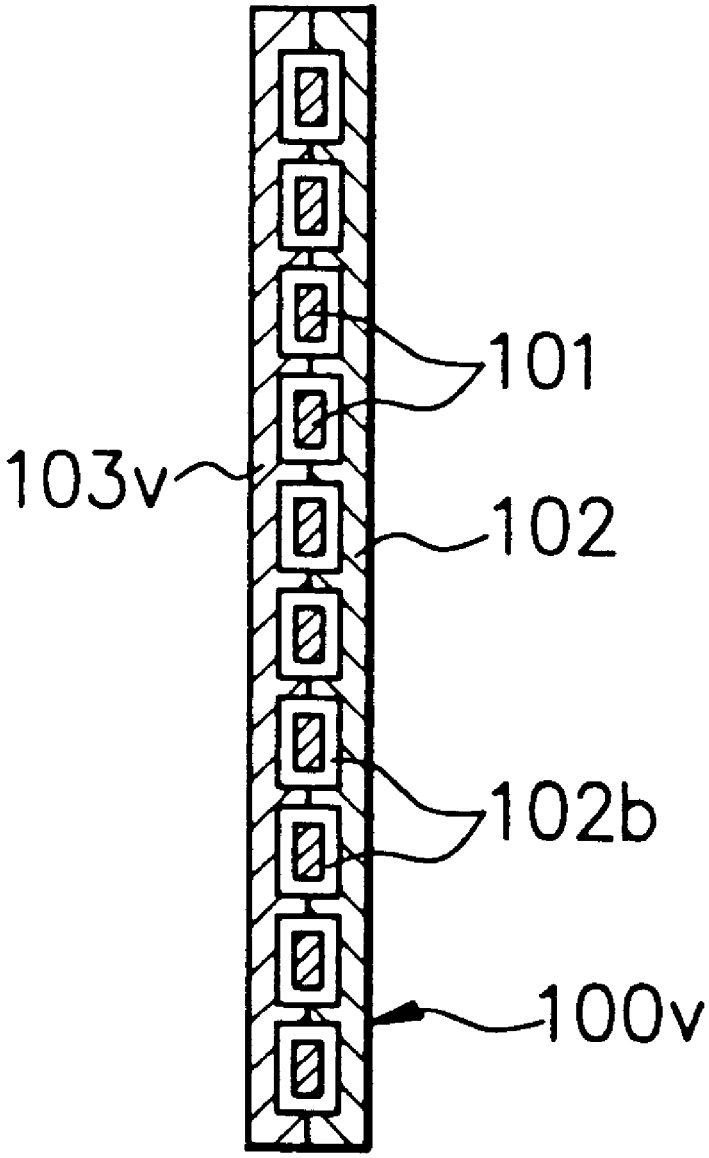
FIG. 24 is a schematic sectional view of a delay line according to a second embodiment of this invention.
Figure 26:
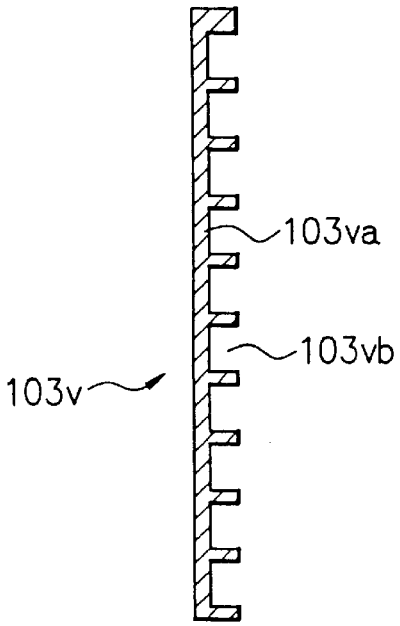
FIG. 26 is a sectional view taken along a line 26—26 in FIG. 25.

In FIGS. 24 and 26, the second outside conductor 103*v* has a second receiving surface 103*va* which defines a second receiving ditch 103*vb*. The second outside conductor 103*v* is positioned to cover the first receiving ditch 102*b* of the first outside conductor 102 so that the second receiving ditch 103*vb* is associated with the first receiving ditch 102*b* of the first outside conductor 102. The second receiving ditch 103*vb* and the first receiving ditch 102*b* receives the first inside conductor 101.

Figure 25:
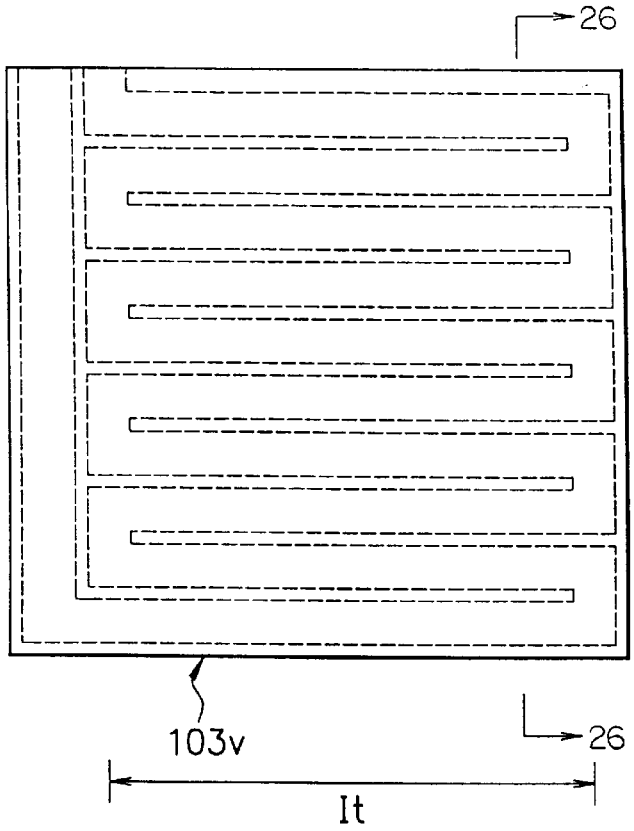
FIG. 25 is a plane view of a second outside conductor of the delay line illustrated in FIG. 24.
Figure 27:
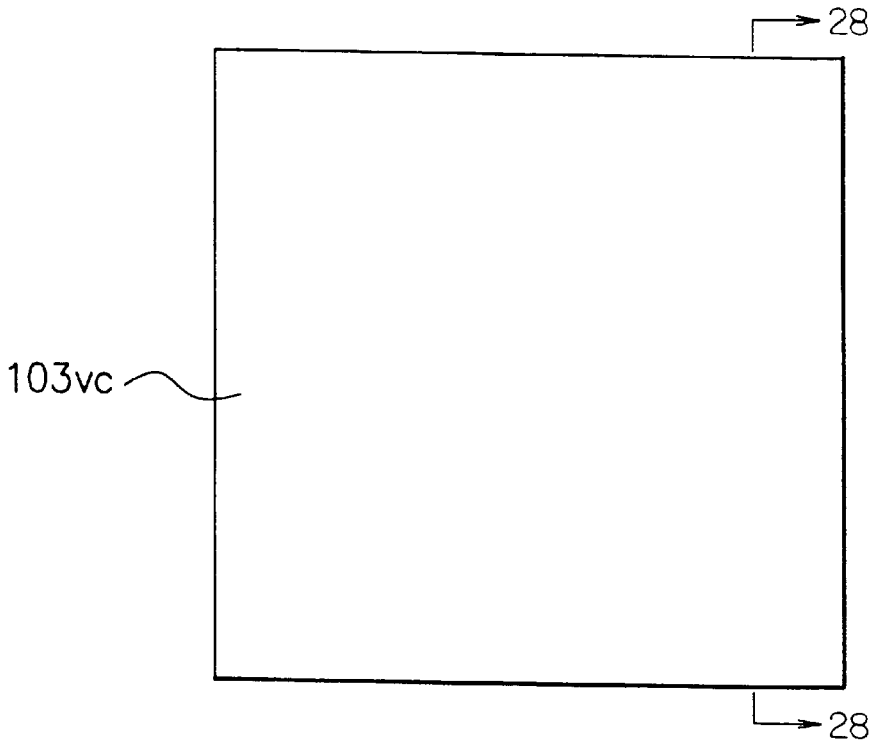
FIG. 27 is a plane view for describing a manufacturing method of the second outside conductor of the delay line illustrated in FIG. 25.
Figure 28:
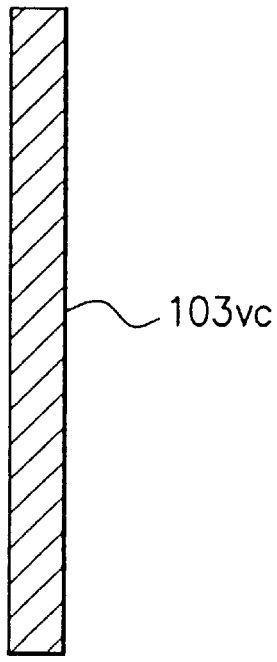
FIG. 28 is a sectional view taken along a line 28—28 in FIG. 27.

Referring to FIGS. 27 and 28 together with FIGS. 24 to 26, the description will proceed to a delay line manufacturing method for manufacturing the delay line 100*v*. Similar parts are designated by like reference numerals.

As shown in FIGS. 27 and 28, a metal plane 103*vc*was prepared. The metal plane 103*vc* has a thickness of a few mm. As shown in FIGS. 24 and 26, the inside conductor 103*v* was formed by punching, by a punching metal, the metal plane 103*vc*. Other steps of the delay line manufacturing method for manufacturing the delay line 100*v* are same to the steps of the delay line manufacturing method for manufacturing the delay line 100.

Figure 29:
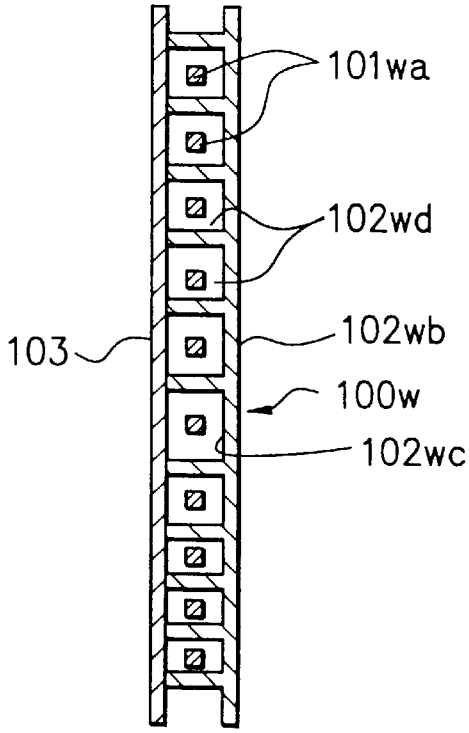
FIG. 29 is a schematic sectional view of a delay line according to a third embodiment of this invention.
Figure 30:
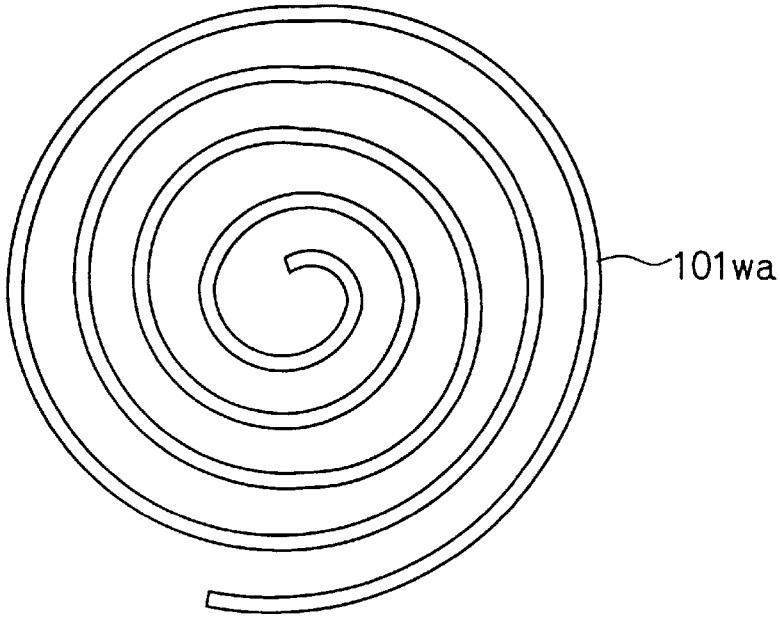
FIG. 30 is a plane view of an inside conductor of the delay line illustrated in FIG. 29.
Figure 31:
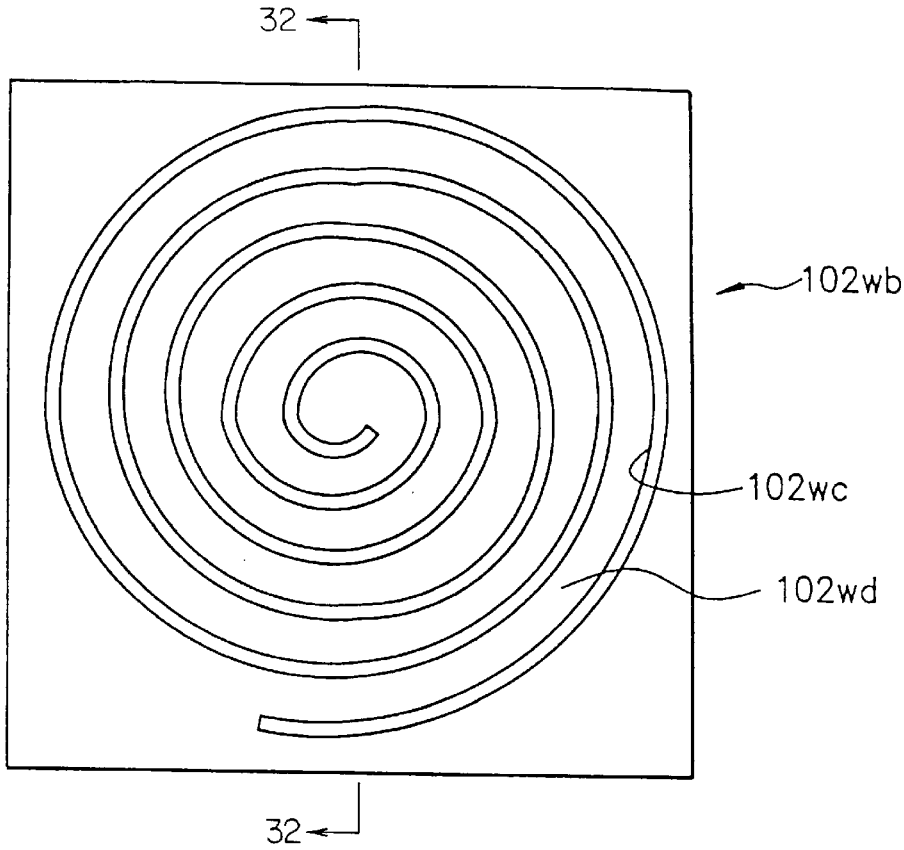
FIG. 31 is a plane view of a first outside conductor of the delay line illustrated in FIG. 29.

Referring to FIGS. 29, 30, and 31, the description will proceed to a delay line according to a third embodiment of this invention. Similar parts are designated by like reference numerals. The delay line 100*w* comprises a first inside conductor 101*wa*, a first outside conductor 102*wb*, the second outside conductor 103, and the dielectric supporting members 104 (FIG. 14).

Figure 32:
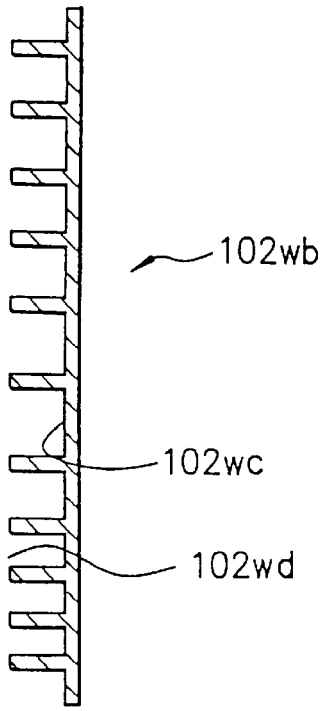
FIG. 32 is a sectional view taken along a line 32—32 in FIG. 31.

In FIG. 30, the first inside conductor 101*wa* has a whirl shape. The first inside conductor 101*wa* was formed by punching, by means of the punching metal. In FIGS. 29, 31, and 32, the first outside conductor 102*wb* has a first inside surface 102*wc* which defines a first receiving ditch 102*wd* which receives the first inside conductor 101*wa*.

Referring to FIGS. 29 to 31, the description will proceed to a delay line manufacturing method for manufacturing the delay line 100*w*. Similar parts are designated by like reference numerals.

Firstly, a metal plane (not shown) was prepared. The metal plane has a thickness of a few mm. As shown in FIG. 30, the first inside conductor 101*wa* was formed by punching, by means of the punching metal, the metal plane. Another metal plane (not shown) was prepared. As shown in FIGS. 29, 31, and 32, the first outside conductor 102*wb* was formed by cutting the other metal plane. Other steps of the delay line manufacturing method for manufacturing the delay line 100*w* are same to the steps of the delay line manufacturing method for manufacturing the delay line 100.

Figure 33:
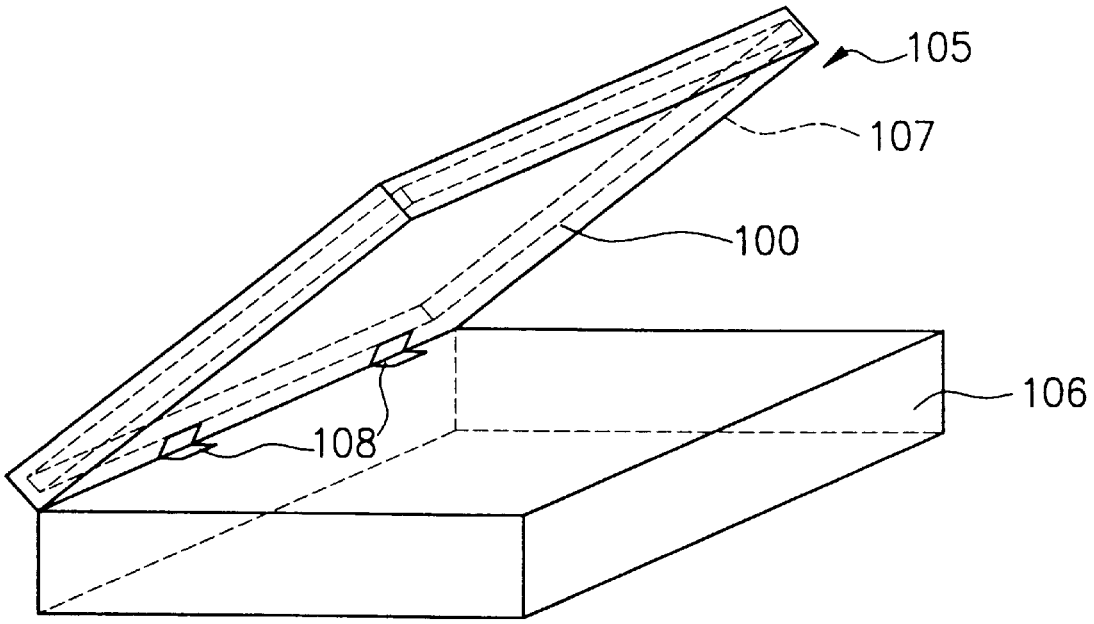
FIG. 33 is a schematic perspective view of a delay line according to a fourth embodiment of this invention.

Referring to FIG. 33, the description will proceed to a delay line according to a fourth embodiment of this invention. The delay line 100 is used as a plane of covering member 105 of a device case 106 which is used in a high frequency power amplifier (not shown). The covering member 105 comprises the delay line 100 and a side plane 107. The covering member 105 is attached, by hinges 108, to the device case 106 so that the covering member 105 is able to be opened and closed. The delay line 100 is electrically connected to the device case 106 by a semi-rigid cable or a high frequency coaxial cable (not shown). In addition, the delay lines 100*v* and 100*w* may be used as the plane of the covering member 105 of the device case 106.

Figure 34:
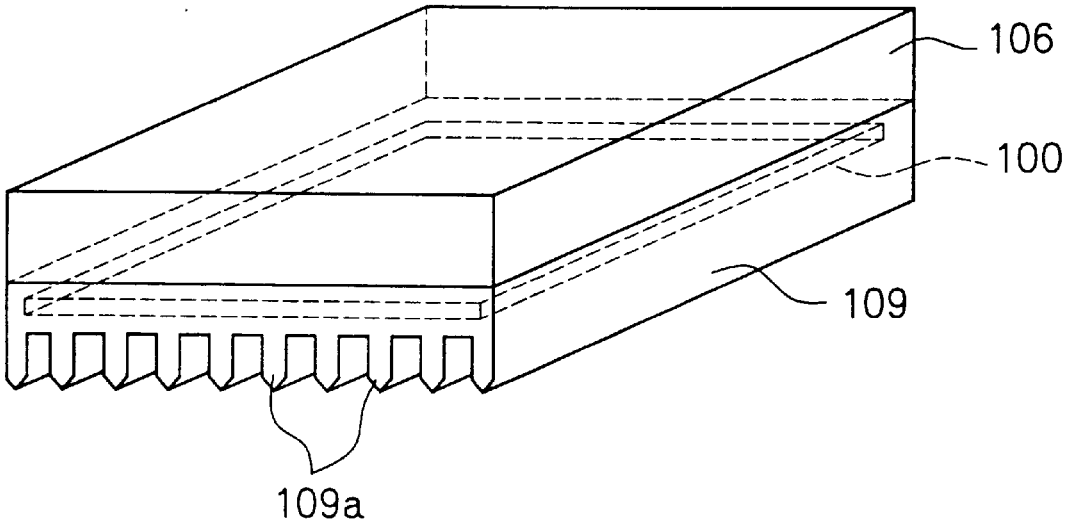
FIG. 34 is a schematic perspective view of a delay line according to a fifth embodiment of this invention.

Referring to FIG. 34, the description will proceed to a delay line according to a fifth embodiment of this invention. The delay line 100 is used as a radiation plane of the device case 106 which is used in the high frequency power amplifier. The delay line 100 is attached to a bottom surface of the device case 106. A radiator 109 is attached to a under surface of the delay line 100. The radiator 109 has a plurality of radiation fins 109*a*. The delay line 100 is electrically connected to the device case 106 by the semirigid cable or the high frequency coaxial cable. In addition, the delay lines 100*v* and 100*w* may be used as the radiation plane of the device case 106.

Figure 35:
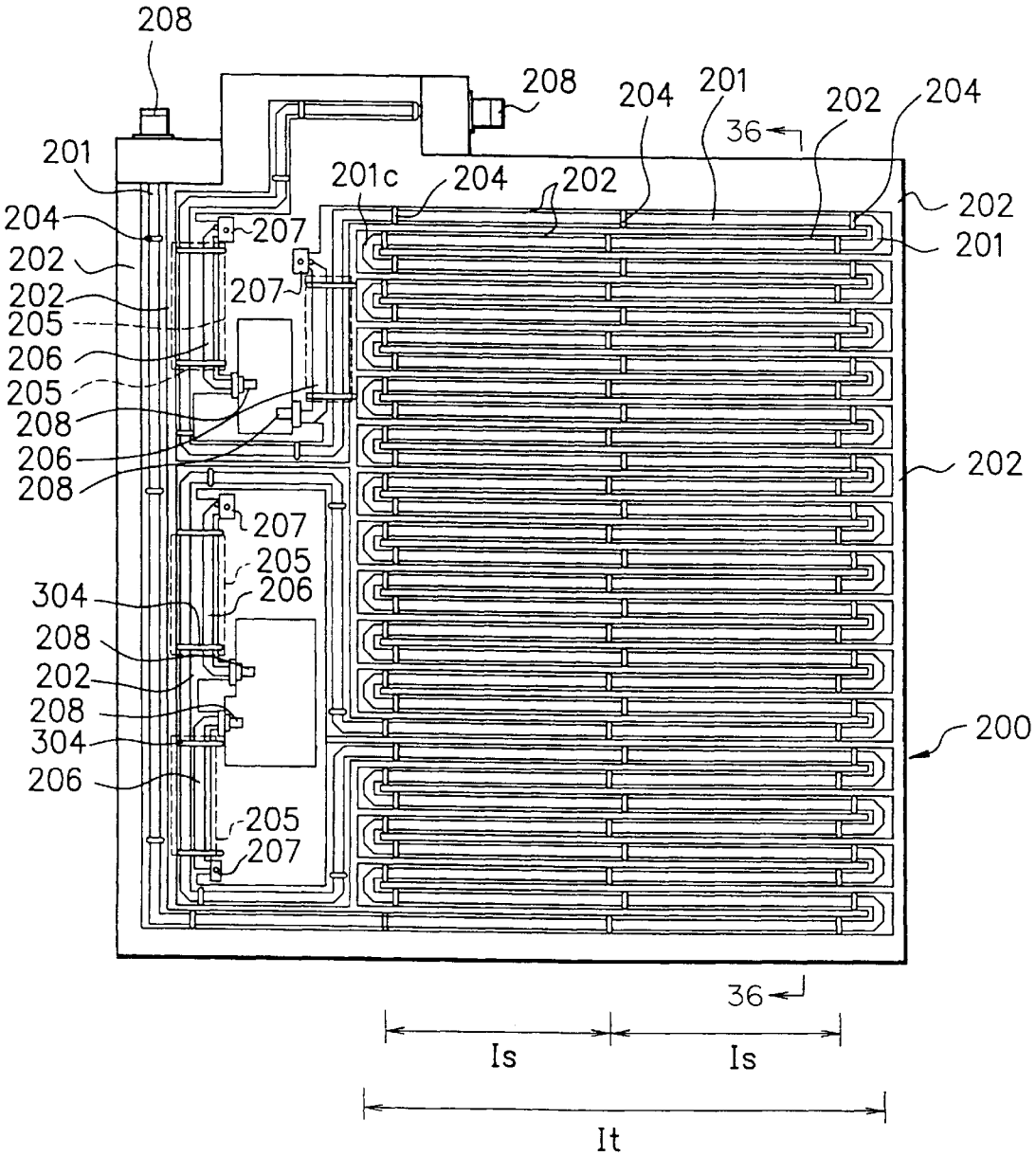
FIG. 35 is a schematic plane view of a delay line according to a sixth embodiment of this invention.
Figure 36:
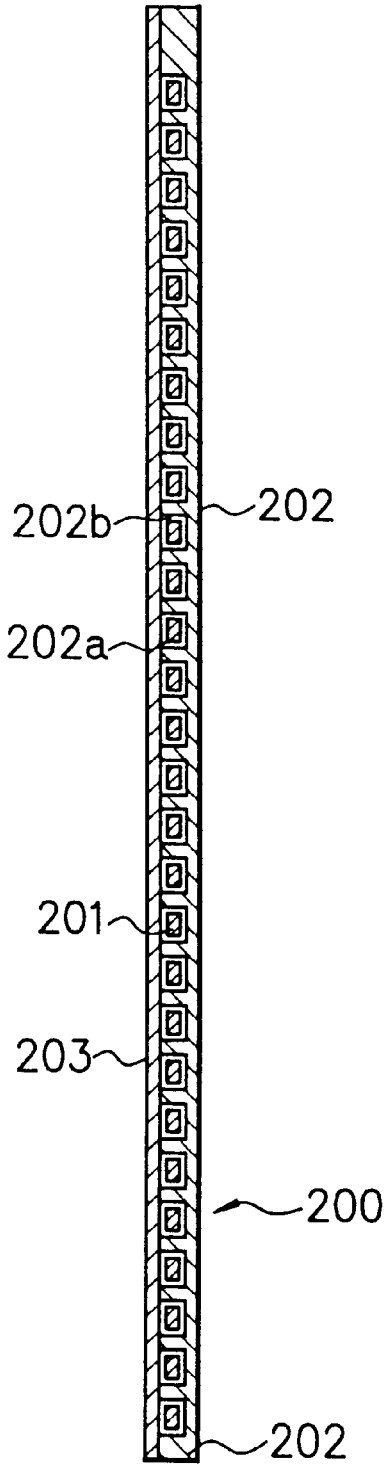
FIG. 36 is a sectional view taken along a line 36—36 in FIG. 35.

Referring to FIG. 35, 36, 37, 38, 39, 40, and 41, the description will proceed to a delay line according to a sixth embodiment of this invention. In FIG. 35, the delay line 200 is used in a high frequency power amplifier of a feed forward type of a cellular telephone base station which uses a high frequency band of about 800 MHz and outputs a high frequency power of about 140 W. In FIGS. 35 and 36, the delay line 200 comprises a first inside conductor 201, a first outside conductor 202, a second outside conductor 203, a plurality of dielectric supporting members 204 and 304, a plurality of directional couplers 205, a plurality of second inside conductors 206, a plurality of termination resistors 207, and a plurality of connectors 208.

Figure 37:
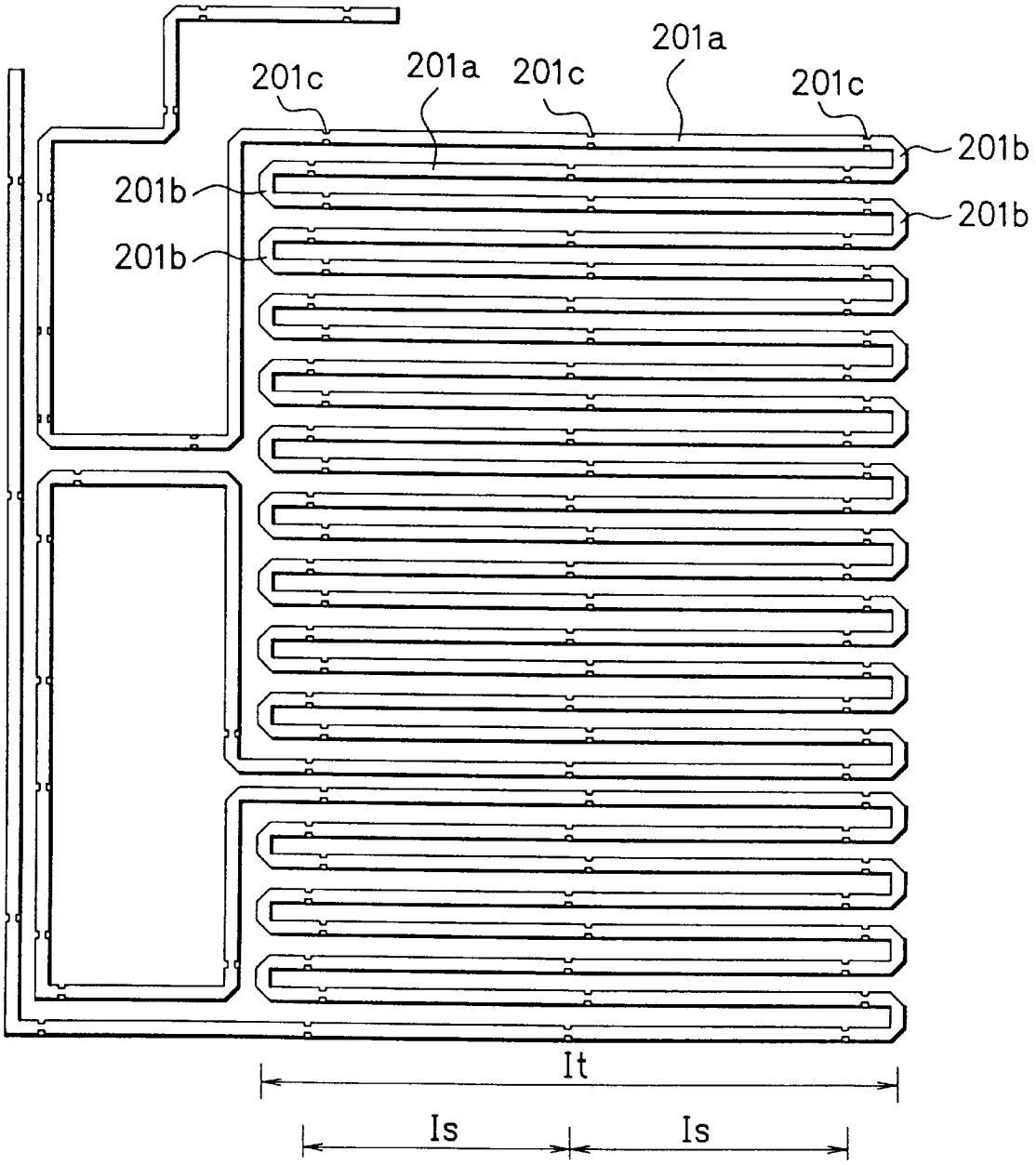
FIG. 37 is a plane view of a first inside conductor of the delay line illustrated in FIG. 35.

In FIGS. 36 and 37, the first inside conductor 201 has a plurality of straight inside conductors 201*a* and a plurality of curved inside conductors 201*b*. Each of the curved inside conductors 201*b* is positioned between adjacent two ones of the straight inside conductors 201*a*. Each of the curved inside conductors 201*b* is connected to ends of the adjacent two ones of the straight inside conductors 201*a*. The straight inside conductors 201*a* has a length It.

Figure 38:
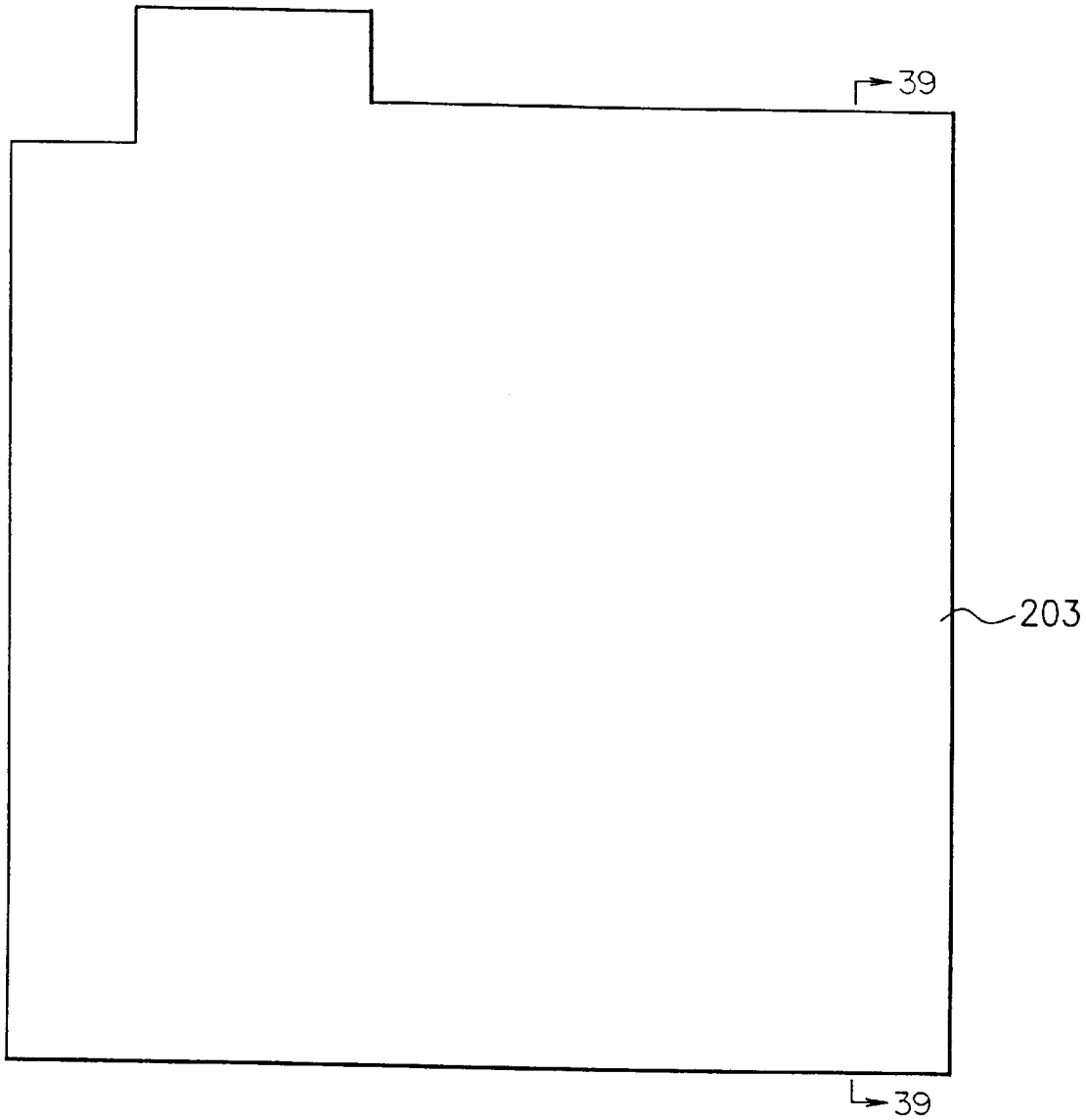
FIG. 38 is a plane view of a second outside conductor of the delay line illustrated in FIG. 35.
Figure 39:
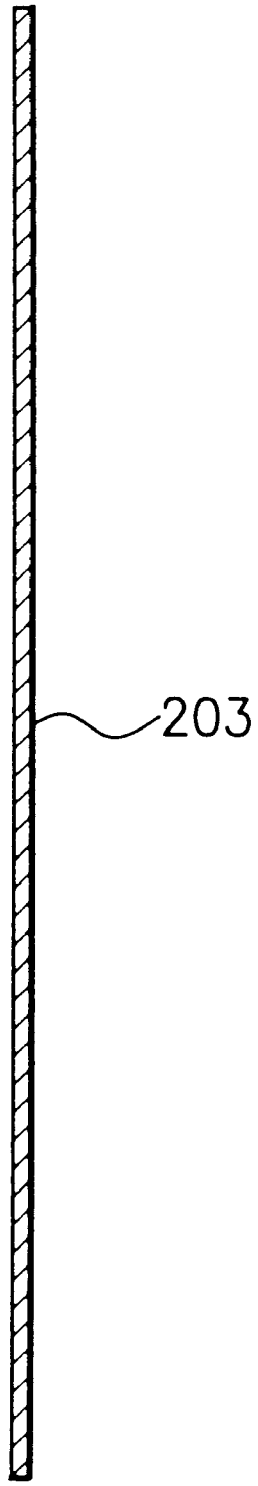
FIG. 39 is a sectional view taken along a line 38—38 in FIG. 38.

In FIGS. 36, the first outside conductor 202 has an first inside surface 202*a* which defines a first receiving ditch 202*b* which receives the first inside conductor 201. The first inside conductor 201 and the first inside surface 202*a* are spaced constant distance apart. In FIGS. 38 and 39, the second outside conductor 203 has a plane shape. The second outside conductor 203 is positioned so that the second outside conductor 203 covers an aperture of the first receiving ditch 202*b* which is defined by the inside surface 202*a*.

The first inside conductor 201, the first outside conductor 202, and the second outside conductor 203 are substantially same to the first inside conductor 101, the first outside conductor 102, and the second outside conductor 103. The dielectric supporting members 204 and 304 are substantially same to the dielectric supporting members 104. The second inside conductor 206 are positioned in parallel to parts of the first inside conductor 201. The second inside conductor 206 are received in the first receiving ditch 202*b*.

A combination of the delay line 200 and the directional couplers 205 is suitable to be used as a part of feed forward loop of a feed forward amplifier. The termination resistors 207 are connected to terminal ends of the second inside conductors 206. The termination resistors 207 are high frequency resistors. The connectors 208 are electrically connected to each of termination portions of the first inside conductor 201, the first outside conductor 202, and the second outside conductor 203. Also, the connectors 208 are electrically connected to an outside high frequency device (not shown).

Figure 40:
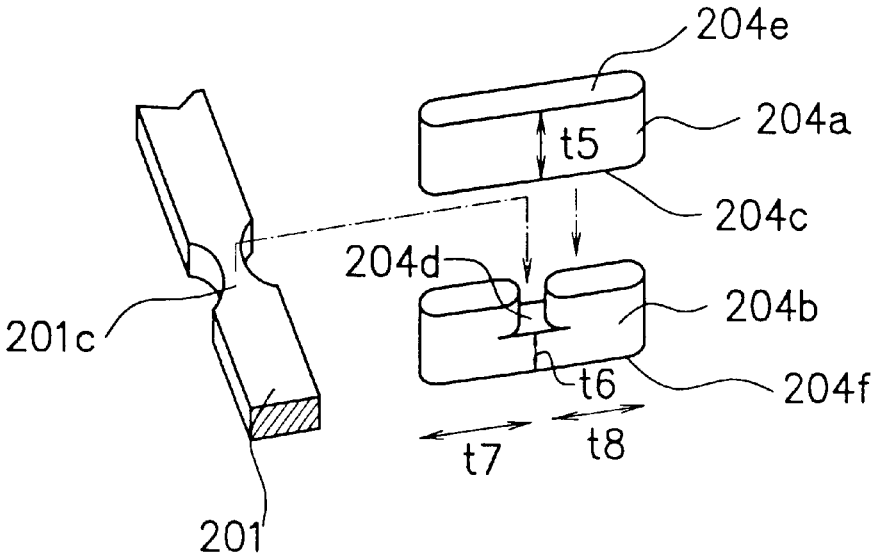
FIG. 40 is a perspective view of a part of the first inside conductor and a supporting member of the delay line illustrated in FIG. 35.
Figure 41:
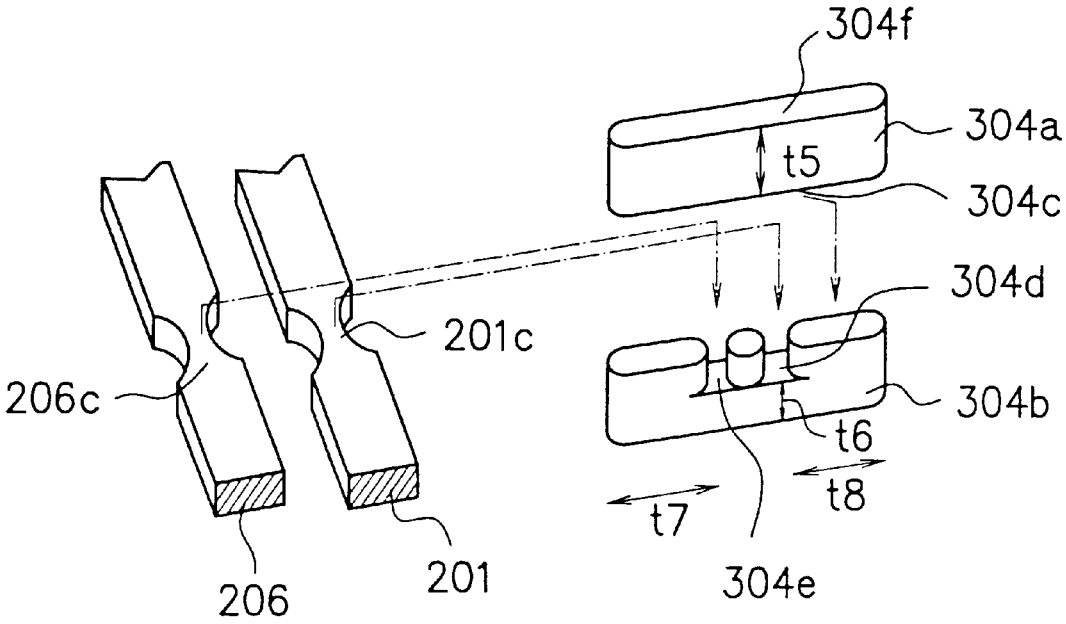
FIG. 41 is a perspective view of a part of the first inside conductor, a second inside conductor, and another supporting member of the delay line illustrated in FIG. 35.

As shown in FIGS. 37, 40, and 41, the first inside conductor 201*c* has a plurality of supporting portions which are narrower than other portions. As shown in FIGS. 35 and 37, a shape of the curved inside conductores 201*b* is selected so as to decrease a reflecting power of the delay line 200. Also, it is set that each of the straight inside conductors 201*a* have a length It which is equal to an odd number times of about ¼ of used wavelength so as to decrease a reflecting power of the delay line 200. This is because a phase of a wavelength of a reflecting wave of the high frequency is shifted by about ½ of the wavelength of the reflecting wave. A whole length of the first inside conductor 201 is determined in response to a necessary electric delay amount. The second outside conductor 203 has a shape shown in FIGS. 38 and 39. In FIG. 41, the second inside conductors 206 have a plurality of supporting members 206*c* which are narrower than other portions.

Turning back to FIGS. 35 and 36, the dielectric supporting members 204 and 304 are positioned in the first receiving ditch 202*b* so that the dielectric supporting members 204 and 304 are in contact with the first inside surface 202*a*. The dielectric supporting members 204 and 304 have superior high frequency characteristic. The dielectric supporting members 204 hold and support the first inside conductor 201. The dielectric supporting members 304 hold and support the first inside conductor 201 and the second inside conductor 206.

In FIG. 40, the dielectric supporting member 204 comprises a first supporting piece 204*a* and a second supporting piece 204*b*.

The first supporting piece 204*a* and the second supporting piece 204*b* have a first nipping surface 204*c* and a second nipping surface 204*d* which are opposed. The first nipping surface 204*c* and the second nipping surface 204*d* nip the first inside conductor 201. Outside surfaces 204*e* and 204*f* of the first supporting piece 204*a* and the second supporting piece 204*b* are in contact with the first inside surface 202*a*. Thereby, the dielectric supporting members 204 holds and supports the first inside conductor 201.

The dielectric supporting members 204 is formed by means of a moulding method. The dielectric supporting members 204 is formed of dielectric material. Preferably, the dielectric supporting members 204 is formed of phytetrafluoroethylene which has high dielectric constant and a small dielectric dissipation factor.

It is assumed that a distance between a top surface of the outside surface 204*e* and the first nipping surface 204*c* is equal to t5, a distance between a bottom surface of the outside surface 204*f* and the second nipping surface 204*d* is equal to t6, a distance between a second side surface of the outside surface 204*e* and a second side surface of the second nipping surface 204*d* is equal to t7, and a distance between a second side surface of the outside surface 204*e* and a second side surface of the second nipping surface 204*d* is equal to t8. In this event, it is set that t5 is equal to t6, t7, and t8 and t5 is constant.

In addition, it may be set that t5 is not equal to t6, t7, and t8 and t5 is not constant. In case of pertinently selecting sizes of the first inside conductor 201, the first outside conductor 202, the second outside conductor 203, the second inside conductors 206, and the dielectric supporting members 204, it is possible to obtain a pertinent line impedance.

Each of the dielectric supporting members 204 has a first dielectric constant. An air has a second dielectric constant which is different from the first dielectric constant. As a result, as line impedances of portions of the delay line 200 change, reflection of the high frequency is caused. In order to prevent occurrence of reflection of the high frequency, it is set that two adjacent ones of the dielectric supporting members 204 are spaced an integral number times of about ¼ of used wavelength apart. Namely, the dielectric supporting members 204 are positioned with the distance Is left between two adjacent ones of the dielectric supporting members 204. Thereby, it is possible to decrease reflecting power of the delay line 200.

In FIG. 41, the dielectric supporting member 304 comprises a first supporting piece 304*a* and a second supporting piece 304*b*. The first supporting piece 304*a* has a first nipping surface 304*c*. The second supporting piece 304*b* has a second nipping surface 304*d* and a third nipping surface 304*e*. The first nipping surface 304*c* is opposed to the second nipping surface 304*d* and the third nipping surface 304*e*. The first nipping surface 304*c* and the second nipping surface 304*d* nip the supporting portions 201*c* of the first inside conductor 201. The first nipping surface 304*c* and the third nipping surface 304*e* nip the supporting portions 206*c* of the second inside conductor 206. Outside surfaces 304*f* and 304*g* of the first supporting piece 304*a* and the second supporting piece 304*b* are in contact with the first inside surface 202*a*. Thereby, the dielectric supporting members 204 holds and supports the first inside conductor 201 and the second inside conductor 206.

The dielectric supporting members 304 is formed by means of a moulding method. The dielectric supporting members 204 is formed of dielectric material. Preferably, the dielectric supporting members 304 is formed of phytetrafluoroethylene which has high dielectric constant and a small dielectric dissipation factor.

It is assumed that a distance between a top surface of the outside surface 304*e* and the first nipping surface 304*c* is equal to t5, a distance between a bottom surface of the outside surface 304*g* and the second nipping surface 304*d* is equal to t6, a distance between a first side surface of the outside surface 304*g* and a first side surface of the second nipping surface 304*e* is equal to t7, and a distance between a second side surface of the outside surface 304*g* and a second side surface of the second nipping surface 304*d* is equal to t8. In this event, it is set that t5 is equal to t6, t7, and t8 and t5 is constant.

In addition, it may be set that t5 is not equal to t6, t7, and t8 and t5 is not constant. In case of pertinently selecting sizes of the inside conductor 201, the first outside conductor 202, the second outside conductor 203, the second inside conductors 206, and the dielectric supporting members 204 and 304, it is possible to obtain a pertinent line impedance.

Each of the dielectric supporting members 204 has a first dielectric constant. An air has a second dielectric constant which is different from the first dielectric constant. As a result, as line impedances of portions of the delay line 200 change, reflection of the high frequency is caused. In order to prevent occurrence of reflection of the high frequency, it is set that two adjacent ones of the dielectric supporting members 204 are spaced an integral number times of about ¼ of used wavelength apart. Thereby, it is possible to decrease a reflecting power of the delay line 200.

In FIGS. 40 and 41, the supporting portions 201*c* and 206*c* of the first and second inside conductors 201 and 206 are narrower than other portions of the first and second inside conductors 201 and 206. In response to this, it is set that t7 is greater than t2. Therefore, each of portions corresponding to t7 has a dielectric constant which is higher than each of portions corresponding to t2. Thereby, a line impedance of the delay line 200 is constant in a whole length of the delay line 200.

Referring to FIGS. 35 to 41, the description will proceed to a delay line manufacturing method for manufacturing the delay line 200. Similar parts are designated by like reference numerals.

Firstly, a first metal plane (not shown) was prepared. The first metal plane has a thickness of a few mm. As shown in FIGS. 37, the first inside conductor 201 was formed by punching, by a punching metal, the first metal plane. Also, a first dielectric plane having a same shape of the first metal plane was prepared. The first inside conductor 201 was formed by galvaning the first dielectric plane to have a metal film after the first dielectric plane were punched by the punching metal.

A second metal plane (not shown) was prepared. The second metal plane has a thickness of a few mm. As shown in FIGS. 35, the second inside conductor 206 was formed by punching, by the punching metal, the second metal plane.

Next, a third metal plane (not shown) was prepared. As shown in FIGS. 35 and 36, the first outside conductor 201 was formed by cutting the third metal plane. Next, as shown in FIGS. 40 and 41, the dielectric supporting members 204 and 304 were formed by means of the moulding method.

Next, the second supporting pieces 204*b* and 304*b* of the dielectric supporting members 204 and 304 were inserted in the first receiving ditch 202*b* of the first outside conductor 202. Thereafter, the first inside conductor 201 was positioned on the second nipping surface 304*d* of the second supporting pieces 304*b*. Next, the second inside conductor 206 was positioned on the third nipping surface 304*e* of the second supporting pieces 304*b*.

Next, the first supporting pieces 204*a* and 304*a* of the dielectric supporting members 204 and 304 was inserted in the first receiving ditch 202*b* of the first outside conductor 202 so that the first supporting pieces 204*a* and 304*a* are positioned on the second supporting pieces 204*b* and 304*b*.

Next, a fourth metal plane (not shown) was prepared. As shown in FIGS. 38 and 39, the second outside conductor 203 was formed by cutting the fourth metal plane. As shown in FIG. 36, the second outside conductor 203 was positioned to cover an aperture of the first receiving ditch 202*b* of the first outside conductor 202. Finally, in this sate, the second outside conductor 203 was fixed, by using screws, to the first outside conductor 202.

In case of manufacturing the delay line which has a frequency of 800 to 900 MHz and a declared power of about 140 W, the delay line has a width of about 400 mm, an overall depth of about 527 mm, and a thickness of about 10 mm.

In the sixth embodiment, the second outside conductor 203 may have a shape which is same to the second outside conductor 103*v*. A plurality of the delay lines may be united. Also, the delay lines may be laminated.

According to the delay line of this invention, it is possible to increase an electric delay amount. This is because the inside conductor has the straight conductors and the curved conductors and the inside conductor has the inside conductor has the whirl shape.

According to the delay line of this invention, it is possible to decrease a high frequency loss. This is because an air having a dielectric constant is used as a dielectric between the inside conductor and the outside conductor.

According to the delay line of this invention, it is possible to decrease a size of the delay line. This is because the inside conductor has the straight conductors and the curved conductors and the inside conductor has the inside conductor has the whirl shape.

According to the delay line of this invention, it is possible to increase radiation effect and a withstand power. This is because the outside conductor has a great surface area.

According to the delay line of this invention, it is easily possible to manufacture the delay line and it is possible to decrease a cost of the delay line. This is because it is possible to manufacture the delay line by punching and cutting and the inside conductor and the outside conductor of the delay line are fixed by screws.

According to the delay line of this invention, it is easily possible to maintain the delay line. This is because it is possible to disassemble the delay line by detaching the screws.

According to the delay line of this invention, the delay line has, in a long time period, superior shock resistant and remarkably stable high frequency characteristic.

What is claimed is:

1. A delay line comprising:

an inside conductor having a plurality of straight inside conductor portions each having two opposing ends, and a plurality of shaped inside conductor portions, each of said shaped inside conductor portions being positioned between two adjacent straight inside conductor portions and connected to one of the ends of each of the two adjacent straight inside conductor portions, wherein the shape of said shaped inside conductor portions is either a trapezoid wherein a longer base side of the trapezoid is connected to said ends of the straight inside conductors, or the shape of said shaped inside conductor is defined by two concentric arcs wherein an outer arc has a radius greater than an inner arc and ends of the outer arc are connected to outer edges of said end of the adjacent straight inside conductors and ends of the inner arc are connected to inner edges of said end of the adjacent straight inside conductors; and an outside conductor having an inside surface defining a receiving ditch, wherein said inside conductor is located within said receiving ditch.

2. A delay line in accordance with claim 1, wherein each of said straight inside conductor portions has a length equal to an odd number times about one fourth a used wavelength.

3. A delay line in accordance with claim 1, said delay line further comprising a plurality of dielectric supporting members positioned in said receiving ditch supporting and holding said inside conductor.

4. A delay line in accordance with claim 3, wherein each of said straight inside conductor portions has a length equal to an odd number times about one fourth a used wavelength.

5. A delay line in accordance with claim 3, wherein two adjacent ones of said dielectric supporting members are spaced apart by a distance equal to an integral number times about one fourth the used wavelength.

6. A delay line in accordance with claim 1 wherein said outside conductor comprises:

a first outside conductor portion having an inside surface defining said receiving ditch; and a second outside conductor portion covering an aperture of said receiving ditch.

7. A delay line in accordance with claim 6, wherein each of said straight inside conductor portions has a length equal to an odd number times about one fourth the used wavelength.

8. A delay line in accordance with claim 6, wherein said delay line further comprises a plurality of dielectric supporting members positioned in said receiving ditch supporting and holding said inside conductor.

9. A delay line in accordance with claim 8, wherein each of said straight inside conductor portions has a length equal to an odd number times about one fourth the used wavelength.

10. A delay line in accordance with claim 8, wherein two adjacent ones of said dielectric supporting members are spaced an integral number times about one fourth the used wavelength.

11. A delay in accordance with claim 6 a first outside conductor having an inside surface which defines a receiving ditch which receives said first inside conductor;

a second outside conductor which covers an aperture of said receiving ditch; and a second inside conductor positioned in parallel to a part of said first inside conductor wherein said inside conductor further comprises;

a first inside conductor member and a second inside conductor member parallel to said first inside conductor member.

12. A delay line in accordance with claim 11, wherein each of said straight inside conductor portions has a length equal to an odd number times about one fourth the used wavelength.

13. A delay line in accordance with claim 11, wherein said delay line further comprises a plurality of dielectric supporting members positioned in said receiving ditch supporting and holding said inside conductor.

14. A delay line in accordance with claim 13, wherein each of said straight inside conductor portions has a length equal to an odd number times about one fourth the used wavelength.

15. A delay line in accordance with claim 13, wherein two adjacent ones of said dielectric supporting members are spaced an integral number times about one fourth the used wavelength.

16. A delay line in accordance with claim 1 wherein said inside conductor further comprises:

a first inside conductor member and a second inside conductor member parallel to at least part of said first inside conductor member.

17. A delay line in accordance with claim 16, wherein each of said straight inside conductor portions has a length equal to an odd number times about one fourth the used wavelength.

18. A delay line in accordance with claim 16, wherein said delay line further comprises a plurality of dielectric supporting members positioned in said receiving ditch supporting and holding said inside conductor.

19. A delay line in accordance with claim 18, wherein each of said straight inside conductor portions has a length equal to an odd number times about one fourth the used wavelength.

20. A delay line in accordance with claim 18, wherein two adjacent ones of said dielectric supporting members are spaced an integral number times about one fourth the used wavelength.

21. A delay line comprising:

an inside conductor capable of conducting a high frequency wave signal, said inside conductor having a plurality of straight conductor portions and a plurality of shaped conductor portions attached to ends of said straight conductor portions, said shaped conductor portions being shaped to minimize signal reflections of said high frequency wave signal;

an outside conductor having an inner surface defining a channel for receiving said inside conductor, wherein said inside conductor is maintained equidistant from said inner surface by a plurality of dielectric support members, said dielectric support members being positioned within said channel and having an outside support member surface in direct contact with said inner surface of said outside conductor and having an inside support member surface in direct contact with said inside conductor, whereby said inside conductor is supported and held in position by said dielectric supporting members.

22. A delay line in accordance with claim 21 wherein said dielectric support members are formed from phytetrafluoroethylene.

23. A delay line in accordance with claim 21 wherein each of said straight inside conductor portions has a length equal to an odd multiple of about one fourth of a wavelength of said high frequency wave signal.

24. A delay line in accordance with claim 21 wherein each of said dielectric support members are spaced apart from each other by a distance equal to an integral multiple about one fourth of a wavelength of said high frequency wave signal.

25. A delay line comprising:

an inside conductor capable of conducting a high frequency wave signal, said inside conductor having a plurality of straight conductor portions having two ends thereof, and a plurality of shaped conductor portions attached to the ends of said straight conductor portions, said shaped conductor portions being shaped to minimize signal reflections of said high frequency wave signal;

an outside conductor having an inner surface defining a channel for receiving said inside conductor, wherein said inside conductor is maintained at a variable distance from said inner surface by a plurality of dielectric support members, said dielectric support members being positioned within said channel and having an outside support member surface in direct contact with said inner surface of said outside conductor and having an inside support member surface in direct contact with said inside conductor, wherein a line impedance of said delay line changes in dependence on said variable distance.

* * * * *